US006733650B2

(12) United States Patent
Sonoda et al.

(10) Patent No.: US 6,733,650 B2
(45) Date of Patent: May 11, 2004

(54) APPARATUS AND PROCESS FOR PRODUCING ZINC OXIDE FILM

(75) Inventors: Yuichi Sonoda, Nara (JP); Kozo Arao, Santa Clara, CA (US); Noboru Toyama, Osaka (JP); Yusuke Miyamoto, Kyoto (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 09/897,012

(22) Filed: Jul. 3, 2001

(65) Prior Publication Data

US 2003/0010644 A1 Jan. 16, 2003

(30) Foreign Application Priority Data

Jul. 3, 2000 (JP) ..... 2000-200471
Jul. 2, 2001 (JP) ..... 2001-200809

(51) Int. Cl.[7] ..... C25D 7/06

(52) U.S. Cl. ..... 205/141; 205/129; 205/130; 205/138; 205/320; 205/333; 205/99

(58) Field of Search ..... 204/202, 205, 204/206, 225; 205/129, 130, 138, 141, 320, 333, 99

(56) References Cited

U.S. PATENT DOCUMENTS 4,806,223 A * 2/1989 Murakami ..... 204/206
6,077,411 A * 6/2000 Nakamura ..... 205/138
6,123,824 A * 9/2000 Sano et al. ..... 205/124
6,132,569 A 10/2000 Shiozaki ..... 204/192.27
6,133,061 A 10/2000 Sonoda ..... 438/69

FOREIGN PATENT DOCUMENTS

JP 10-178193 6/1998
JP 11-286799 10/1999

OTHER PUBLICATIONS

H. Sannomiya et al., "a–SiC/a–Si/a–SiGe Multi–Bandgap Stacked Solar Cells With Bandgap Profiling," *Technical Digest of the International PVSEC–5*, P–IA–15, pp. 387–390 (1990), no month avail.

Y. Inoue et al., "Optical Confinement Effect in a–SiGe Solar Cells on Stainless Steel Substrates," *The 51st Applied Physics Society Scientific Lecture Meeting, Lecture Drafts*, 29p–MF–2, p. 747 (1990), no month avail.

* cited by examiner

*Primary Examiner*—Wesley A. Nicolas
(74) *Attorney, Agent, or Firm*—Fitzpatrick, Cella, Harper & Scinto

(57) ABSTRACT

Disclosed are a process for producing a zinc oxide film comprising the steps of transporting a conductive long substrate via above at least one electrode comprised of zinc in an electrodeposition bath held in an electrodeposition tank and applying an electric field between the electrode and the conductive long substrate, thereby forming a zinc oxide film on the conductive long substrate, the process comprising a first step of forming the zinc oxide film on a part of the conductive long substrate; a second step of stopping the application of the electric field and the transportation; and a third step of bringing at least a region of a part of the conductive long substrate being in contact with the electrodeposition bath in the second step into non-contact with the electrodeposition bath, and an apparatus suitably used for the process. The process and apparatus enables high-quality zinc oxide films to be produced.

6 Claims, 13 Drawing Sheets

APPARATUS AND PROCESS FOR PRODUCING ZINC OXIDE FILM

BACKGROUND OF THE INVENTION

1. Field of the Invention

The present invention relates to an apparatus and a process for producing a zinc oxide film that forms a zinc oxide thin film on a long size substrate (simply referred to as "long substrate") such as a stainless steel sheet by electrodeposition, and more particularly to an apparatus and a process for producing a zinc oxide film that can effectively prevent soil (or contamination) from being generated in a bath or a rinsing tank or on a long substrate for a period of time from startup of the apparatus after one electrodeposition to subsequent electrodeposition.

2. Related Background Art

Photovoltaic elements comprised of amorphous silicon hydride, amorphous silicon germanium hydride, amorphous silicon hydride carbide, microcrystalline silicon or polycrystalline silicon are conventionally provided with reflecting layers on their backs in order to improve light-collection efficiency in the long-wavelength regions. It is desirable for such reflecting layers to show effective reflection characteristics at wavelengths which are close to band edges of semiconductor materials and at which absorption becomes small, i.e., wavelengths of 800 nm to 1,200. Those which can fulfill such a condition are metals such as gold, silver, copper, aluminum, etc.

It is also prevalent to provide an uneven layer which is optically transparent within a stated wavelength region and is known as an optical confinement layer. This transparent uneven layer is generally provided between the metal layer and a semiconductor active layer so that reflected light can effectively be utilized to improve short-circuit current density Jsc. Further, in order to prevent characteristics from lowering because of shunt pass, it is still also prevalent to provide between the metal layer and a semiconductor layer a layer formed of a light-transmitting material showing a conductivity, i.e., a transparent conductive layer. In general, these layers are deposited by a process such as vacuum evaporation or sputtering and show an improvement in short-circuit current density Jsc by 1 mA/cm$^2$ or above.

As an example thereof, in "Optical Confinement Effect in a-Si Solar Cells on 29p-MF-2 Stainless Steel Substrates" (autumn, 1990), The 51st Applied Physics Society Scientific Lecture Meeting, Lecture Drafts p. 747, 'P-IA-15a-SiC/a-Si/a-SiGe Multi-Bandgap Stacked Solar Cells with Bandgap Profiling', Sannomiya et al., Technical Digest of The International PVSEC-5, Kyoto, Japan, p. 387, 1990, reflectance and texture structure were studied on a reflecting layer comprised of silver atoms. In this example, it is reported that the reflecting layer is deposited in a double layer of silver by changing substrate temperature, to form effective unevenness, which has achieved an increase in short-circuit current by virtue of an optical confinement effect.

The transparent layer used as an optical confinement layer is deposited by vacuum evaporation utilizing resistance heating or electron beams, sputtering, ion implantation or CVD (chemical vapor deposition). However, the facts of high wages for preparing target materials and so forth, a large repayment for vacuum apparatus and not a high utilization efficiency of materials make very high the cost for photovoltaic elements produced by these techniques, and put a high barrier to Industrial application of solar cells.

As a technique for forming a zinc oxide film by electrodeposition from an aqueous solution, intended to solve these problems. Japanese Patent Application Laid-Open No. 10-178193 discloses its combination with a metal layer and a transparent conductive layer which are formed by sputtering, applied as a reflecting layer of photovoltaic elements (solar cells). Also, as an improved technique of such a zinc oxide production technique, Japanese Patent Application Laid-Open No. 11-286799 by the present inventors discloses a zinc oxide film forming technique in which the roll-to-roll system is adopted to carry out successive electrodeposition on a long substrate.

These methods do not require any expensive vacuum apparatus and any expensive targets, and can dramatically reduce the production cost for zinc oxide films. These also enable deposition on a large-area substrate, and are full of promise for large-area photovoltaic elements such as solar cells.

However, these methods of making deposition electrochemically have the following problems.

That is, in an electrodeposition apparatus of the roll-to-roll system that holds a conductive long substrate above zinc, when the conductive long substrate is left to be dipped in an electrodeposition bath for an extended period of time from completion of one electrodeposition to subsequent electrodeposition, there are cases where deposition of zinc, zinc hydroxide or the like may occur to give rise to adsorption and to increase particles in the electrodeposition bath, thereby generating abnormal growth in the zinc oxide thin film. Further, metal components in the conductive long substrate may be dissolved into the electrodeposition bath.

Moreover, deposits or particles generated in the electrodeposition bath due to decrease of solubility by temperature lowering will accumulate on the zinc to degrade the uniformity of the film during the subsequent electrodeposition.

Further, when the conductive long substrate that adsorbs zinc, zinc hydroxide or the like is transported as such to a rinsing tank, the rinsing tank will be contaminated with particles, or rinsing failure or adhesion of particles to the surface of the zinc oxide thin film will occur.

In the production of a zinc oxide thin film by electrodeposition using the roll-to-roll system, any optimum electrodeposition apparatus capable of solving the above mentioned problems have not been provided.

SUMMARY OF THE INVENTION

Accordingly, the present invention has been accomplished taking account of the above mentioned problems, and an object of the present invention is to establish a novel technique for repeatedly using an electrodeposition bath in an electrodeposition apparatus for forming a zinc oxide thin film using the roll-to-roll system, to provide an apparatus and a process for producing a high-performance, low-cost zinc oxide thin film, and to contribute to real spread of the photovoltaic power generation by incorporating elements produced by the production apparatus and process into photovoltaic elements According to a first aspect of the present invention, there is provided an apparatus for producing a zinc oxide film comprising an electrodeposition tank for holding an electrodeposition bath, at least one electrode comprised of zinc provided in the electrodeposition tank, transporting mechanism for transporting a conductive long substrate via above the electrode in the electrodeposition bath held in the electrodeposition tank, and a power source for applying an electric field between the electrode and the conductive long substrate, the apparatus further comprising means for bringing the conductive long substrate and the electrodeposition bath into non-contact state.

According to a second aspect of the present invention, there is provided an apparatus for producing a zinc oxide film comprising an electrodeposition tank for holding an electrodeposition bath, at least one electrode comprised of zinc provided in the electrodeposition tank, transporting mechanism for transporting a conductive long substrate via above the electrode in the electrodeposition bath held in the electrodeposition tank, and a power source for applying an electric field between the electrode and the conductive long substrate, the apparatus further comprising holding means for holding at least a part of the conductive long substrate above the electrodeposition bath.

According to a third aspect of the present invention, there is provided a process for producing a zinc oxide film comprising the steps of transporting a conductive long substrate via above at least one electrode comprised of zinc in an electrodeposition bath held in an electrodeposition tank and applying an electric field between the electrode and the conductive long substrate, thereby forming a zinc oxide film on the conductive long substrate, the process comprising:

a first step of forming the zinc oxide film on a part of the conductive long substrate;

a second step of stopping the application of the electric field and the transportation; and a third step of bringing at least a part of a part of the conductive long substrate being in contact with the electrodeposition bath in the second step into non-contact with the electrodeposition bath.

As a preferred embodiment, the present invention provides the apparatus further comprising means for bringing the electrode and the electrodeposition bath into non-contact state.

As another preferred embodiment, the present invention provides the apparatus further comprising a circulation system connected to the electrodeposition tank, for circulating the electrodeposition bath, and a filter provided in the circulation system, for removing soil in the electrodeposition bath.

As still another preferred embodiment, the present invention provides the process further comprising after the third step, a fourth step of redipping in the electrodeposition bath the region as brought into non-contact with the electrodeposition bath in the third step, and a fifth step of restarting the application of the electric field and the transportation to form a zinc oxide film on the conductive long substrate.

As yet another preferred embodiment, the present invention provides the process wherein the water level of the electrodeposition bath is lowered in the third step.

As yet sill another preferred embodiment, the present invention provides the process wherein in the third step, at least a part of the part of the conductive long substrate being in contact with the electrodeposition bath is held by holding means provided above the electrodeposition bath to bring at least a region of the part of the conductive long substrate being in contact with the electrodeposition bath in the second step into non-contact with the electrodeposition bath.

As again another preferred embodiment, the present invention provides the process wherein the conductive long substrate comprises a conductive layer comprised of silver.

As still another preferred embodiment, the present invention provides the process wherein the electrodeposition bath contains zinc ions of 0.05 mol/L or more.

DESCRIPTION OF THE PREFERRED EMBODIMENTS

Preferred embodiments of the present invention will be described with reference to the drawings, but it should be understood that the present invention is not limited to the embodiments.

The present invention makes it possible to form a zinc oxide thin film having a high optical confinement effect effective for improving solar cell characteristics and having a high reliability so that it can make larger the amount of electric current produced by light-collection and also contribute to an improvement in reliability. The invention moreover intends to achieve such aims inexpensively and stably in an industrial scale. The basic concept for this end is that in an electrodeposition apparatus of the roll-to-roll system, by lowering the water level of the electrodeposition bath after electrodeposition process than the level of the long substrate, the soil of the long substrate, electrodeposition bath and rinsing tank is decreased to form a zinc oxide thin film with a high reliability.

However, merely making the water level of the electrodeposition bath lower than the long substrate does not attain the aims, and means for effectively lowering the water level and other countermeasures are necessary.

The present inventors have found such means as well as countermeasures, which has accomplished the present invention.

Figure 1:
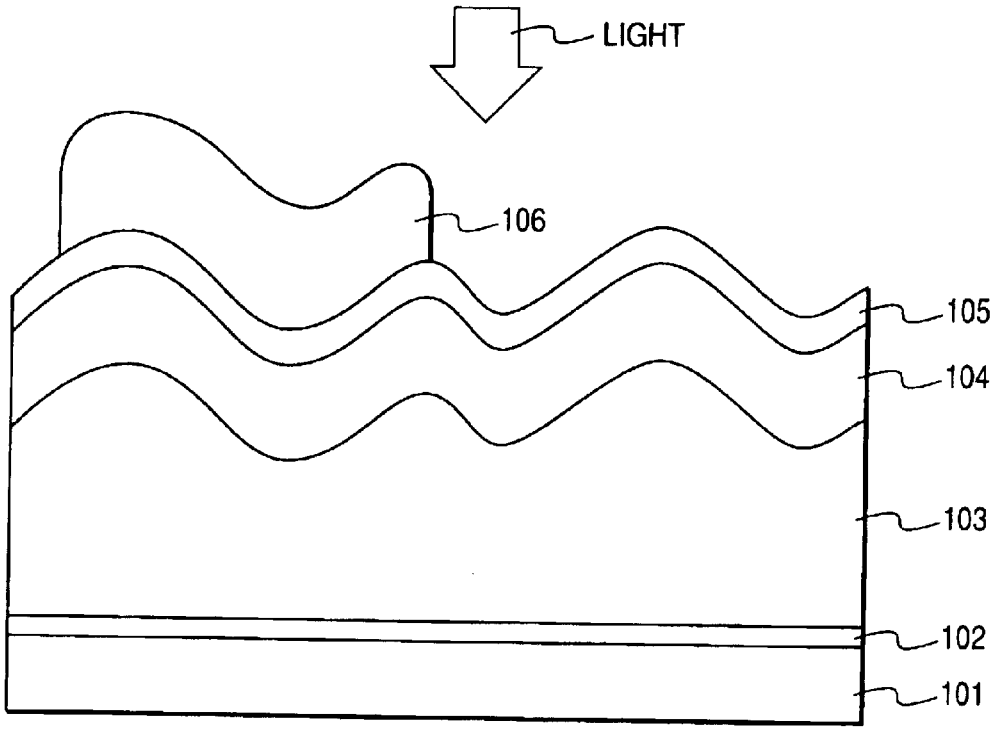
FIG. 1 is a schematic view showing a sectional constitution of a photovoltaic element using the zinc oxide thin film in accordance with the present invention.

FIG. 1 is a schematic view showing a sectional constitution of a photovoltaic element using the zinc oxide thin film in accordance with the present invention. In FIG. 1, reference numeral 101 denotes a support; 102, a back surface reflecting layer (metal layer); 103, a zinc oxide layer (transparent conductive layer) formed by electrodeposition; 104, a semiconductor layer; 105, a transparent electrode layer; and 106, a current collector electrode. Incidentally, when the element is so constructed that a light enters from the support side, the respective layers are formed in reverse order except for the support.

Other constituents of the present invention are described below.

(Formation of Zinc Oxide Layer by Electrodeposition)

Figure 10:
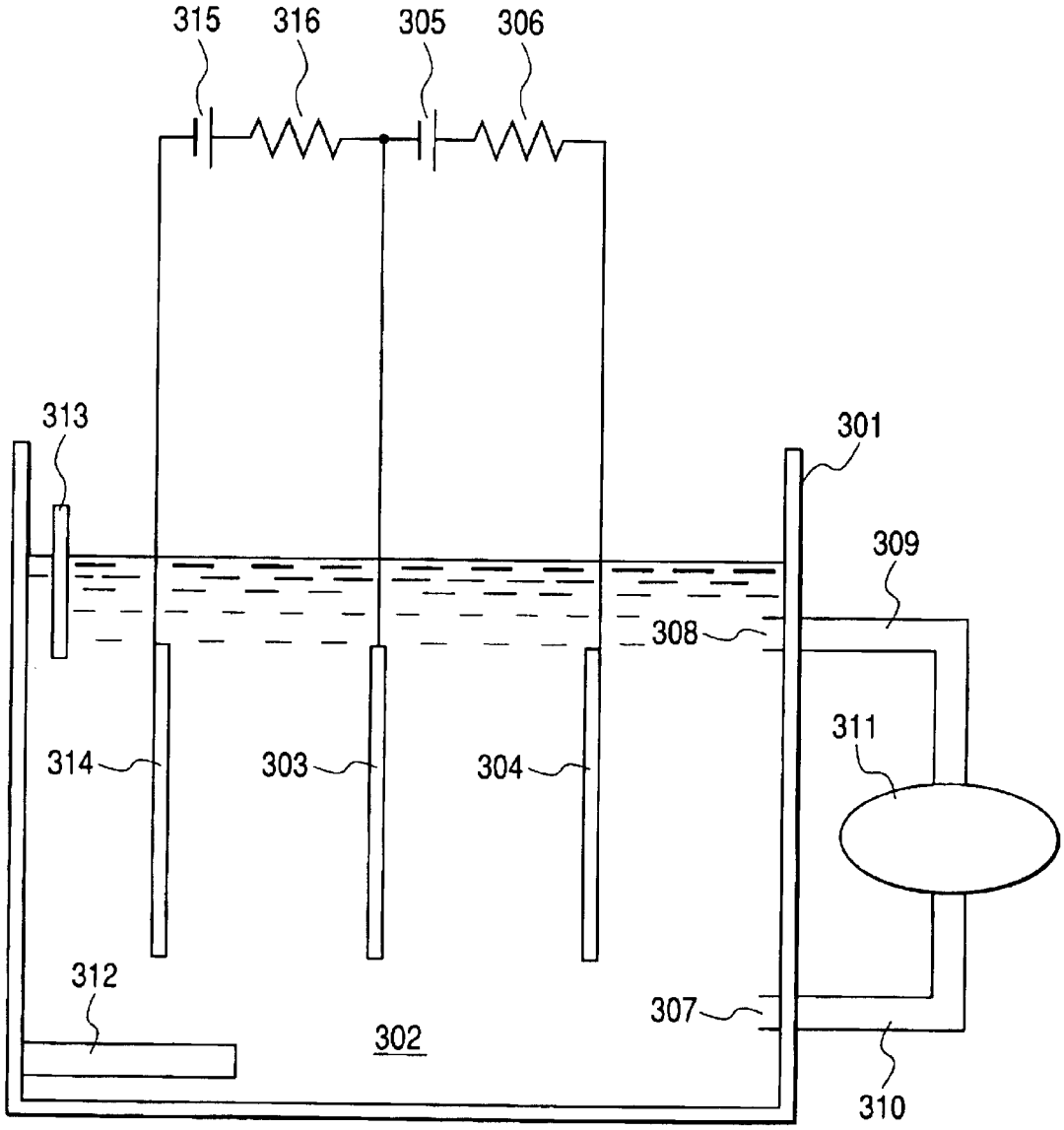
FIG. 10 is a schematic constitutional view showing a zinc oxide thin film forming apparatus.

As a method of forming the zinc oxide thin film, a layer may be formed by means of, e.g., an apparatus shown in FIG. 10. In FIG. 10, reference numeral 301 denotes an anti-corrosion container, and an aqueous electrodeposition solution 302 contains nitrate ions preferably in an ion concentration of 0.004 mol/L to 6.0 mol/L, more preferably 0.001 mol/L to 1.5 mol/L, and optimally 0.1 mol/L to 1.4 mol/L. The zinc ions may preferably be in an ion concentration of 0.002 mol/L to 3.0 mol/L, more preferably 0.01 mol/L to 2.0 mol/L, and optimally 0.05 mol/L to 1.0 mol/L. Incidentally, the effect of the invention of suppressing the abnormal growth or particle generation is attained significantly when the zinc ion concentration is 0.05 mol/L or more.

When an aqueous solution containing sucrose or dextrin is used in order to prevent abnormal growth, the sucrose may preferably be in a concentration of 500 g/L to 1 g/L, and more preferably 100 g/L to 3 g/L. The dextrin may preferably be in a concentration of 10 g/L to 0.01 g/L, and more preferably 1 g/L to 0.025 g/L. Such measures enable well efficient formation of a zinc oxide thin film having a textural structure suited for the optical confinement effect.

As shown in FIG. 10, a substrate 303 and an opposing electrode 304 are connected to a power source 305 via a load resistor 306. Here, electric current may preferably be at a density of 0.1 $mA/cm^2$ to 100 $mA/cm^2$, more preferably 1 $mA/cm^2$ to 30 $mA/cm^2$, and optimally 3 $mA/cm^2$ to 15 $mA/cm^2$.

In FIG. 10, reference numeral 314 denotes a back-side film adhesion preventive electrode. The substrate 303 and the back-side film adhesion preventive electrode 314 are connected to a power source 315 via a load resistor 316. A negative electric current is flowed to the substrate 303. Here, the electric current may preferably be at a density of −0.01 $A/cm^2$ to −80 $mA/cm^2$, more preferably −0.1 $A/cm^2$ to −15 $mA/cm^2$, and optimally −1 $A/cm^2$ to −10 $mA/cm^2$.

The distance between the electrode 314 and the substrate 303 may be set not larger than 50 cm, and preferably not larger than 10 cm, whereby the back-side film adhesion preventive effect can efficiently be attained. As materials, conductive materials such as SUS stainless steel, Zn, Ti and Pt are preferred.

The solution temperature may be set at 60° C. or above, whereby a uniform zinc oxide film with less abnormal growth can be formed in a good efficiency. To stir the whole solution, a solution circulation system is used which consists of a solution pump-in opening 308, a solution pump-out opening 307, a solution circulation pump 311, a pump-in solution pipe 309 and a pump-out solution pipe 310. When the solution is of a small scale, a magnetic stirrer may be used.

(Working Apparatus)

Figure 2:
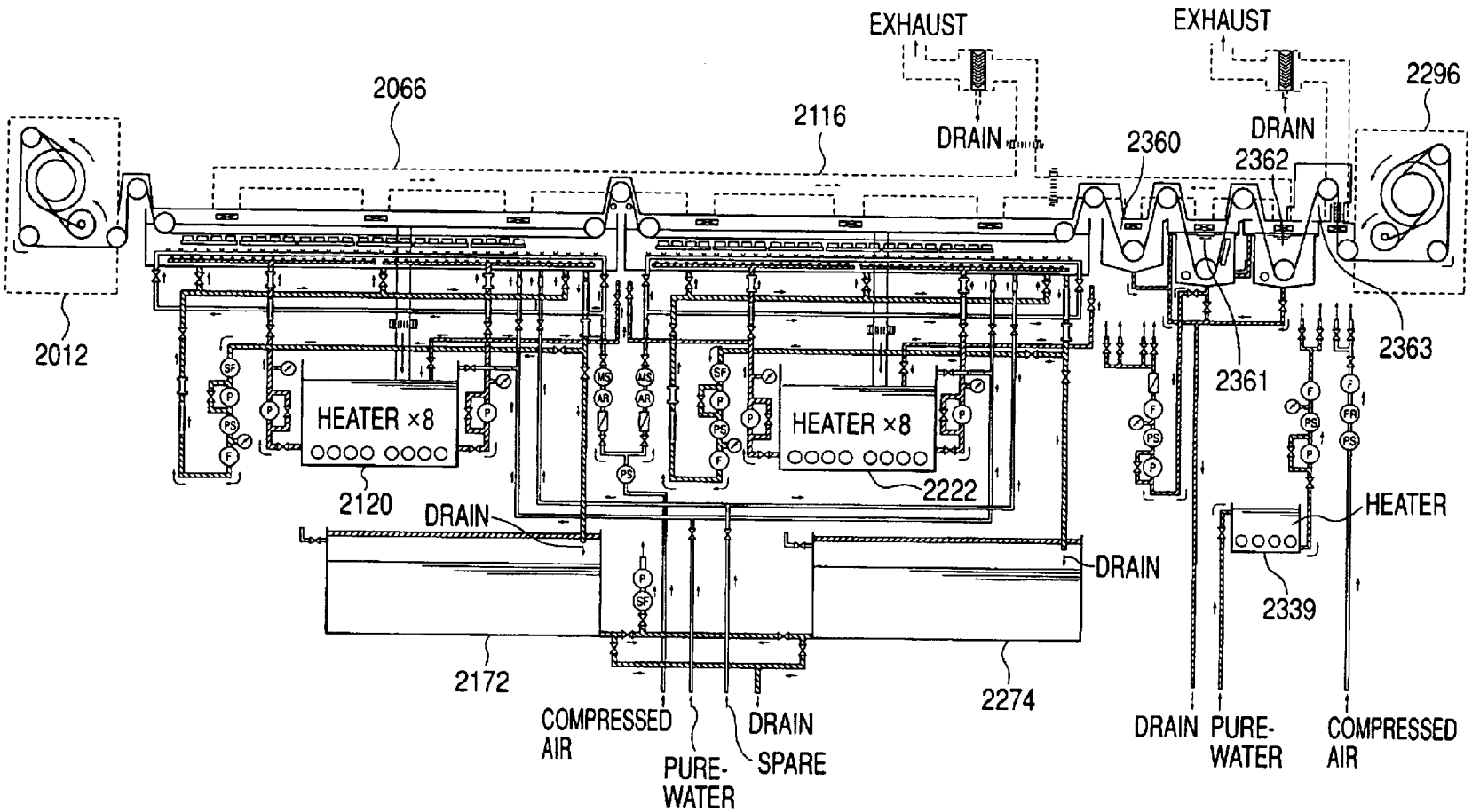
FIG. 2 is a schematic constitutional view showing a zinc oxide thin film forming apparatus according to an embodiment of the present invention.

A long substrate electrodeposition apparatus that the present inventors have actually made after extensive studies is shown in FIG. 2. Its dividedly enlarged views are also given in FIGS. 3 to 9. In FIG. 2 and FIGS. 3 to 9, names and reference numerals of respective members are common. A procedure for forming or depositing an electrodeposited film on a long substrate by means of this apparatus is described below with reference to these drawings.

Roughly sectioned, the apparatus consists of a wind-off unit 2012 from which a long substrate wound into a coil is wound off, a first electrodeposition tank 2066 in which a first electrodeposition film is deposited or treated, a second electrodeposition tank 2166 in which a second electrodeposition film is deposited or treated, a first circulation tank 2120 from which a heated electrodeposition bath is circulatingly fed to the first electrodeposition tank, a second circulation tank 2222 from which a heated electrodeposition bath is circulatingly fed to the second electrodeposition tank, a first waste-solution tank 2172 in which the electrodeposition bath is temporarily stored before the bath of the first electrodeposition tank 2066 is discharged, a second waste-solution tank 2274 in which the electrodeposition bath is temporarily stored before the bath of the second electrodeposition tank 2116 is discharged, a filter circulation system for removing particles in the electrodeposition bath held in the first electrodeposition tank 2066 to make the bath clean (a piping system connected to a first electrodeposition tank filter circulation filter 2161), a filter circulation system for removing particles in the electrodeposition bath held in the second electrodeposition tank 2116 to make the bath clean (a piping system connected to a second electrodeposition tank filter circulation filter 2263), a piping system for sending bath-stirring compressed air to both the first electrodeposition tank 2066 and the second electrodeposition tank 2116 (a piping system extending from a compressed air feed inlet 2182), a pure-water shower tank 2360 in which the long substrate on which the electrodeposition film has been deposited is washed with a pure-water shower, a first hot-water tank (here is called "hot water" since hot water is used for the pure water of a rinsing tank) 2361 in which first pure-water rinsing is carried out, a second hot-water tank 2362 in which second pure-water rinsing is carried out, a pure-water heating tank 2339 from which necessary pure-water hot water is fed to these hot-water tanks, a drying section 2363 which dries the long substrate with film (film-deposited substrate) after it has been washed, a wind-up unit 2296 for winding again into a coil the long substrate on which film deposition has been completed, and an exhaust system for discharging water vapor generated at the stage of heating the electrodeposition bath or pure water and at the stage of drying (an exhaust system constituted of an electrodeposition water washing system exhaust duct 2020, or a drying system exhaust duct 2370).

The long substrate is transported on from the left to the right as viewed in the drawing, in the order of the wind-off unit 2012, the first electrodeposition tank 2066, the second electrodeposition tank 2116, the pure-water shower tank 2360, the first hot-water tank 2361, the second hot-water tank 2362, the drying section 2363 and the wind-up unit 2296, so that a stated electrodeposition film is deposited.

Figure 3:
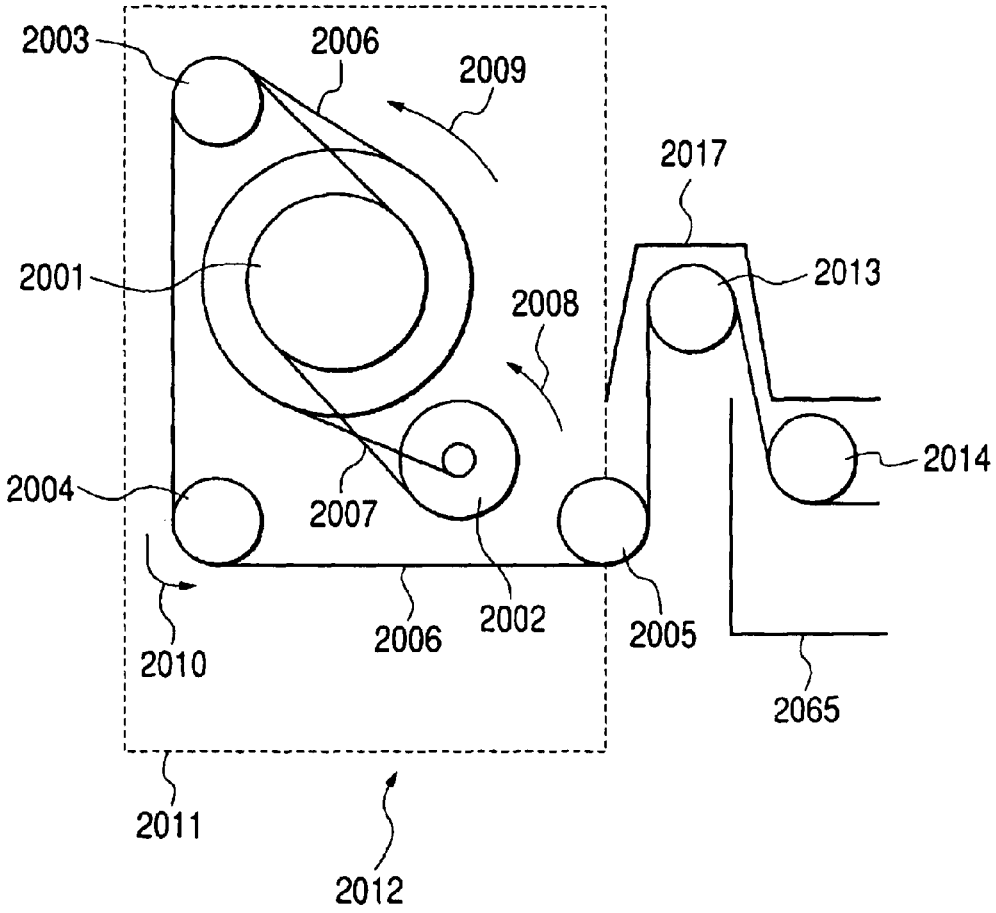
FIG. 3 is a schematic constitutional view showing a wind-off unit of the zinc oxide thin film forming apparatus of FIG. 2.

In the wind-off unit 2012, as shown in FIG. 3 a long substrate 2006 wound into a coil on a long substrate bobbin 2001 is set, and the long substrate 2006 is wound off through a feed control roller 2003, a direction-changing roller 2004 and a delivery roller 2005 in this order. Especially where a subbing layer has been deposited on the coil-shaped long substrate, the substrate is supplied in the form where an interleaf (interleaving paper) has been rolled up so that the substrate or layer can be protected. Accordingly, in the case where the interleaf has been rolled up, an interleaf 2007 is wound up on an Interleaf wind-up bobbin 2002 as the long substrate is wound off. The direction in which the long substrate 2006 is transported is shown by an arrow 2010, the direction in which the long substrate bobbin 2001 is rotated is shown by an arrow 2009, and the direction in which the interleaf wind-up bobbin 2002 is wound up is shown by an arrow 2008. The figure shows that the long substrate delivered from the long substrate bobbin 2001 and the interleaf wound up on the interleaf wind-up bobbin 2002 are not interfered with each other at the transport-starting position and the transport-ending position. For the purpose of dust-proofing, the whole wind-off unit is so structured as to be covered with a wind-off unit clean booth 2011 making use of a HEPA (high-frequency particulate air) filter and a down flow.

Figure 4:
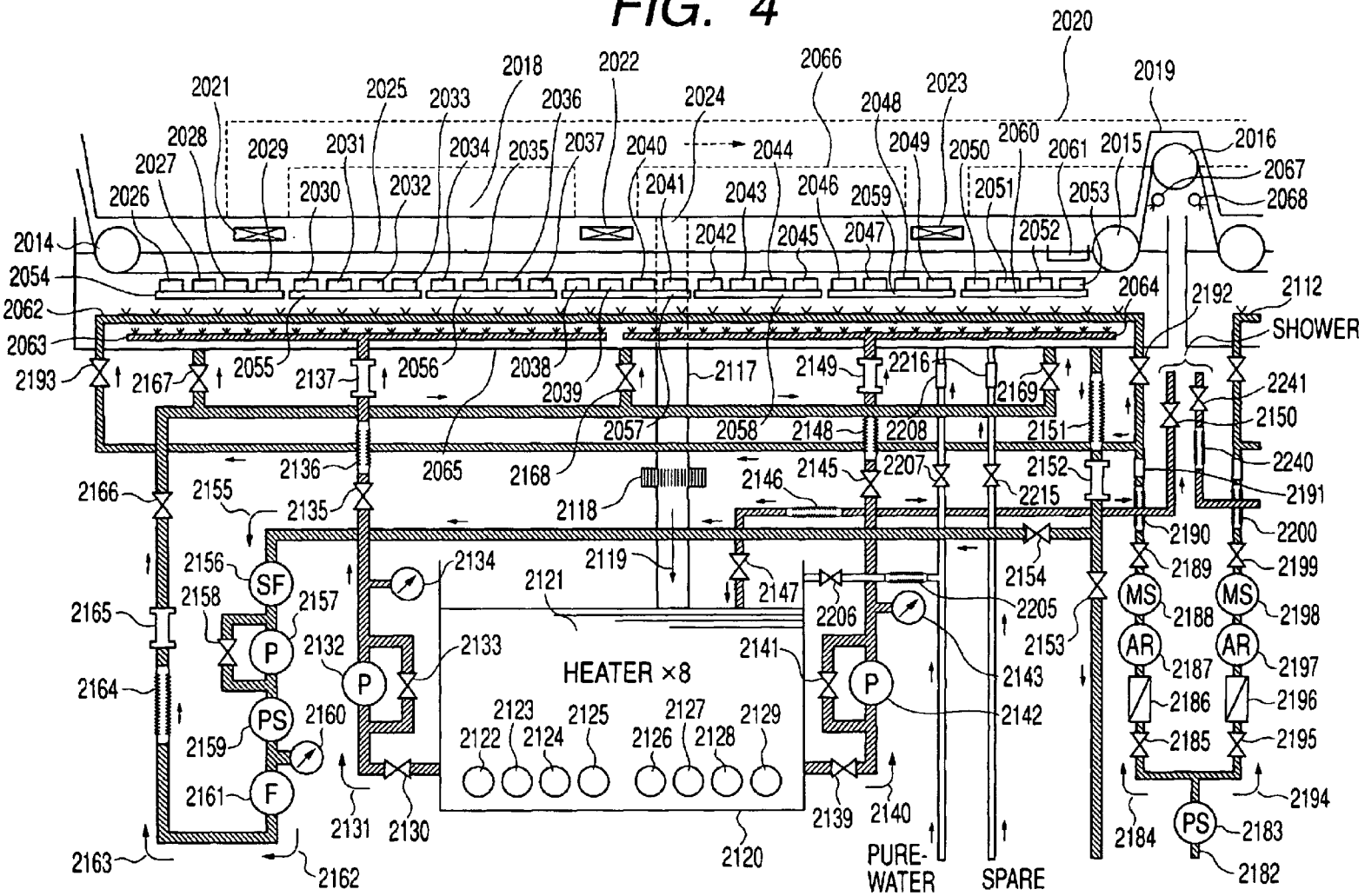
FIG. 4 is a schematic constitutional view showing a first electrodeposition tank and related units of the zinc oxide thin film forming apparatus of FIG. 2.

The first electrodeposition tank 2066 comprises, as shown in FIG. 4, a first electrodeposition bath holder tank 2065 which is not corrosive against the electrodeposition bath and can keep the temperature of the electrodeposition bath, and in that tank a temperature-controlled electrodeposition bath is so held as to have a first electrodeposition bath surface 2025. The position of this bath surface is realized by an over flow attributable to a partition plate provided inside the first electrodeposition bath holder tank 2065. The partition plate (not shown) is so installed that the electrodeposition bath is let fall toward the inner-part side by the whole first electrodeposition bath holder tank 2065. The overflowed electrodeposition bath collected in tub structure in a first electrodeposition tank overflow return opening 2024 comes to the first circulation tank 2120 through a first electrodeposition tank overflow return path 2117, where the bath is heated and is circulated again into the first electrodeposition bath holder tank 2065 from a first electrodeposition tank upstream circulation jet pipe 2063 and a first electrodeposition tank downstream circulation jet pipe 2064 to form an inflow of the electrodeposition bath in a quantity enough for prompting the overflow.

The long substrate 2006 is passed through the inside of the first electrodeposition tank 2066 via an electrodeposition tank entrance turn-back roller 2013, a first electrodeposition tank approach roller 2014, a first electrodeposition tank withdrawal roller 2015 and an electrodeposition tank-to-tank turn-back roller 2016. Between the first electrodeposition tank approach roller 2014 and the first electrodeposition tank withdrawal roller 2015, at least the film-forming side underside surface (often called "surface side" in the present specification) of the long substrate lies in the electrodeposition bath and faces twenty-eight anodes 2026 to 2053. In actual electrodeposition, negative potential is applied to the long substrate and positive potential to the anodes, and electrodeposition electric current which causes electrochemical reaction concurrently is flowed across the both in the electrodeposition bath to effect electrodeposition.

In the apparatus shown in FIG. 2, the anodes in the first electrodeposition tank 2066 are four by four placed on seven anode stands 2054 to 2060. The anode stands are so structured that the respective anodes are placed thereon through insulating plates, and are so made that individual potential is applied from independent power sources. Also, the anode stands 2054 to 2060 have the function to keep distance between the long substrate 2006 and the anodes 2026 to 2053 in the electrodeposition bath. Accordingly, in usual cases, the anode stands 2054 to 2060 are so designed and produced that their height is adjustable to keep a predetermined distance between the both.

A first electrodeposition tank back-side film adhesion preventive electrode 2061 provided immediately before the first electrodeposition tank withdrawal roller 2015 is an anode for electrochemically removing any film deposited unwontedly in the bath on the long substrate on its side opposite to the film-forming side (often called "back side" in the present specification). This is materialized by bringing the back-side film adhesion preventive electrode 2061 to a negative-side potential with respect to the long substrate. Whether or not the back-side film adhesion preventive electrode 2061 has its effect actually is confirmable by visually observing that a film of the same materials as the film formed on the film-forming side of the long substrate is fast removed on and on which adheres electrochemically to the back, the side opposite to the film-forming side of the long substrate, because of come-around of an electric field.

On the film-deposited long substrate having passed the first electrodeposition tank withdrawal roller 2015 and having come out of the electrodeposition bath, the electrodeposition bath is sprayed from a first electrodeposition tank exit shower 2067 to prevent the film-formed surface from drying to cause unevenness. Also, an electrodeposition tank-to-tank cover 2019 provided at a cross-over portion between the first electrodeposition tank 2066 and the second electrodeposition tank 2116 entraps the vapor generated from the electrodeposition bath, to prevent the film-formed surface of the long substrate from drying. Still also, a second electrodeposition tank entrance shower 2068 likewise acts to prevent it from drying.

The first circulation tank 2120 functions to heat the electrodeposition bath fed into the first electrodeposition tank 2066 to keep its temperature and jet-circulate it. As described previously, the electrodeposition bath having overflowed from the first electrodeposition tank 2066 is collected at the overflow return opening 2024, then passes the overflow return path 2117, and comes to a first circulation tank heating and holding tank 2121 via a first electrodeposition tank overflow return path insulating flange 2118.

Inside the first circulation tank heating and holding tank 2121, eight heaters 2122 to 2129 are provided, and are made to function when a room-temperature electrodeposition bath is initially heated or when the electrodeposition bath having come to have a low bath temperature as a result of circulation is again heated to keep the electrodeposition bath at a stated temperature.

Two circulation systems are connected to the first circulation tank heating and holding tank 2121. More specifically, they are a first electrodeposition tank upstream circulation flow-back system through which the electrodeposition bath returns from the first electrodeposition tank upstream circulation jet pipe 2063 to the first electrodeposition bath holder tank 2065 via an upstream circulation main valve 2130, an upstream circulation pump 2132, an upstream circulation valve 2135, an upstream circulation flexible pipe 2136 and an upstream circulation flange insulating pipe 2137, and a first electrodeposition tank downstream circulation flow-back system through which the electrodeposition bath returns from the first electrodeposition tank downstream circulation jet pipe 2064 to the first electrodeposition bath holder tank 2065 via a downstream circulation main valve 2139, a downstream circulation pump 2142, a downstream circulation valve 2145, a downstream circulation flexible pipe 2148 and a downstream circulation flange insulating pipe 2149. The electrodeposition bath which returns from the upstream circulation jet pipe 2063 and downstream circulation jet pipe 2064 to the first electrodeposition tank 2066 is circulated so that the electrodeposition bath can effectively be exchanged in the first electrodeposition bath holder tank 2065, and is circulated as jets from the upstream circulation jet pipe 2063 and downstream circulation jet pipe 2064 provided at a lower part of the first electrodeposition bath holder tank 2065, through orifices bored in their respective jet pipes. The amount of flowing back of each circulation flow-back system is chiefly controlled by the degree at which the upstream circulation valve 2135 or downstream circulation valve 2145 is opened or closed, and is more delicately controllable by an upstream circulation pump by-pass valve 2133 or a downstream circulation pump by-pass valve 2141, which is provided in a by-pass system connected by by-passing the upstream circulation pump 2132 or downstream circulation pump 2142 at its exit and entrance. Such by-pass systems also have the function to prevent any cavitation in the pumps when the electrodeposition bath is circulated in a small quantity or has a bath temperature very close to the boiling point. The cavitation which may make the bath solution boil to vaporize to make any liquid unfeedable may shorten the lifetime of pumps greatly.

When orifices are bored in the first electrodeposition tank upstream circulation jet pipe 2063 and first electrodeposition tank downstream circulation jet pipe 2064 to form jets, the amount of flowing back almost depends on the pressure of the solution returned to the upstream circulation jet pipe 2063 and downstream circulation jet pipe 2064. To know this pressure, a first electrodeposition tank electrodeposition bath upstream circulation pressure gauge 2134 and a first electrodeposition tank electrodeposition bath downstream circulation pressure gauge 2143 are provided so that the balance of the amount of flowing back can be known by these pressure gauges. Stated accurately, the quantity of flowed-back bath solution jetted from the orifices follows the Bernouilli theorem. When, however, the orifices bored in the jet pipes are several millimeters in diameter, the jet quantity can be made substantially constant over the whole first electrodeposition tank upstream circulation jet pipe 2063 or first electrodeposition tank downstream circulation jet pipe 2064. When also the amount of flowing back is sufficiently large, the bath can be exchanged very smoothly. Hence, even when the first electrodeposition tank 2066 is fairly long, making bath concentration uniform and making temperature uniform can effectively be achieved. As a matter of course, the first electrodeposition tank overflow return path 2117 should have a diameter large enough for the bath to be flowed back in a sufficient quantity.

The upstream circulation flexible pipe 2136 and the downstream circulation flexible pipe 2148, which are provided in the respective circulation flow-back systems, absorb any strain of piping systems, and are effective especially when flange insulating piping which tends to have an insufficient mechanical strength is used. The upstream circulation flange insulating pipe 2137 and the downstream circulation flange insulating pipe 2149, which are provided in the respective circulation flow-back systems, make the first circulation tank 2120 and first electrodeposition tank 2066 electrically float together with the first electrodeposition tank overflow return path insulating flange 2118, provided in the course of the first electrodeposition tank overflow return path 2117. This is based on the present inventor's findings that the breaking oft of formation of unauthorized electric-current paths, i.e., the prevention of stray electric current leads to stable and effective procedure of the electrochemical film-forming reaction that utilizes electrodeposition electric current.

The other circulation flow-back system is provided with a by-pass flow-back system which returns directly to the second circulation tank heating and holding tank 2223 and comprises a by-pass circulation flexible pipe 2146 and a by-pass circulation valve 2147. This is used when the bath should be circulated without circulating the bath solution to the first electrodeposition tank 2066, e.g., when the bath temperature is raised from room temperature to a stated temperature. The other circulation flow-back system extending from the first circulation tank 2120 is also provided with a solution feed system which passes the first electrodeposition tank withdrawal roller 2015 and extends to the first electrodeposition tank exit shower 2067. It extends to the first electrodeposition tank exit shower 2067 via a first electrodeposition tank exit shower valve 2150. The amount of the electrodeposition solution sprayed from the exit shower 2067 is regulated by controlling the degree of opening or closing the exit shower valve 2150.

The first circulation tank heating and holding tank 2121 is actually provided with a cover to provide a structure that can prevent the bath from vaporizing to lose water. When the bath has a high temperature, the cover also comes to have a high temperature, and hence it should be taken into consideration to, e.g., attach a heat insulation material. This is necessary in view of the safety of operation.

In order to remove particles floating in the first electrodeposition tank electrodeposition bath, a filter circulation system is provided. A filter circulation system for the first electrodeposition tank 2066 consists of a filter circulation return flexible pipe 2151, a filter circulation return flange insulating pipe 2152, a filter circulation main valve 2154, a filter circulation suction filter 2156, a filter circulation pump 2157, a filter circulation pump by-pass valve 2158, a filter circulation pressure switch 2159, a filter circulation pressure gauge 2160, a filter circulation filter 2161, a filter circulation flexible pipe 2164, a filter circulation flange insulating pipe 2165, a filter circulation valve 2166, a filter circulation system electrodeposition bath upstream return valve 2167, a filter circulation system electrodeposition bath midstream return valve 2168 and a filter circulation system electrodeposition bath downstream return valve 2168. Through this course, the electrodeposition bath flows in the direction of first electrodeposition tank filter circulation directions 2155, 2162 and 2163. The particles to be removed may originate from powder brought in from the outside of the system or may be formed on the electrode surface or in the bath, depending on electrodeposition reaction. Minimum size of the particles to be removed depends on the filter size of the filter circulation filter 2161.

The filter circulation return flexible pipe 2151 and the filter circulation flexible pipe 2164 are pipes for absorbing any strain of piping systems to minimize any liquid leakage from pipe-connected portions and also protect the insulating pipe inferior in mechanical strength so that the constituent parts of the circulation system which includes pumps can be disposed at a greater degree of freedom. The filter circulation return flange insulating pipe 2152 and the filter circulation flange insulating pipe 2165 are provided so that the first electrodeposition bath holder tank 2065 set floating from the ground earth can be made to float electrically to prevent it from falling to the ground earth. The filter circulation suction filter 2156 is a wire cloth like a "tea strainer", so to speak, and is a filter for removing large foreign matter so as to protect the subsequent filter circulation pump 2157 and filter circulation filter 2161. The filter circulation filter 2161 is the leading part of this circulation system, and is a filter for removing any particles having mixed or occurred in the electrodeposition bath. The circulation flow rate of the electrodeposition bath in this circulation system is micro-adjusted primarily by the filter circulation valve 2166, and secondarily by the filter circulation pump by-pass valve 2158, provided in parallel to the filter circulation pump 2157. The filter circulation pressure gauge 2160 is provided in order to catch the circulation flow rate to be adjusted by these valves. The filter circulation pump by-pass valve 2158 not only micro-adjusts the flow rate but also prevents the filter circulation pump 2157 from breaking because of any cavitation which may occur when the whole filter circulation flow rate is reduced.

The electrodeposition bath can be transferred to a first waste-solution tank 2172 through the filter circulation return flange insulating pipe 2152 via a first electrodeposition tank drain valve 2153. This transfer is made when the electrodeposition bath is replaced, when the apparatus is put to maintenance work and also on occasion of emergency. The electrodeposition bath as waste solution to be transferred is fallen by gravity-drop into a first waste-solution tank waste-solution holder tank 2144. For the purpose of maintenance work or emergency measures, the first waste-solution tank waste-solution holder tank 2144 may preferably have a capacity large enough to store the total bath volume in the first electrodeposition tank 2066 and the first circulation tank 2120. The first waste-solution tank waste-solution holder tank 2144 Is provided with a top cover 2277 and, in order to make the gravity-drop transfer of the electrodeposition bath effective, it is provided with an air vent 2172 and a first waste-solution tank air vent valve 2170. The electrodeposition bath which has temporarily been fallen into the first waste-solution tank waste-solution holder tank 2144 is, after its temperature has lowered, sent out through a waste-solution drainage valve 2173 for drainage treatment on the side of a building, or collected in a steel drum (not shown) through a waste-solution collection valve 2174, a waste-solution collection main valve 2175, a waste-solution collection main suction filter 2176 and a waste-solution collection pump 2177 so as to be put to appropriate disposal. Before the collection or treatment, the waste solution may also be diluted with water or treated with chemicals in the waste-solution holder tank 2144.

The above mentioned various circulation systems (including the waste-solution pipes), including the circulation system for the second electrodeposition tank as described below, can be used in order to bring a part of the conductive substrate (i.e., a part which is in contact with the electrodeposition bath during electrodeposition) into non-contact with the electrodeposition bath. That is, the circulation systems can be used to lower the water level of the electrodeposition bath thereby attaining the non-contact state.

Figure 12:
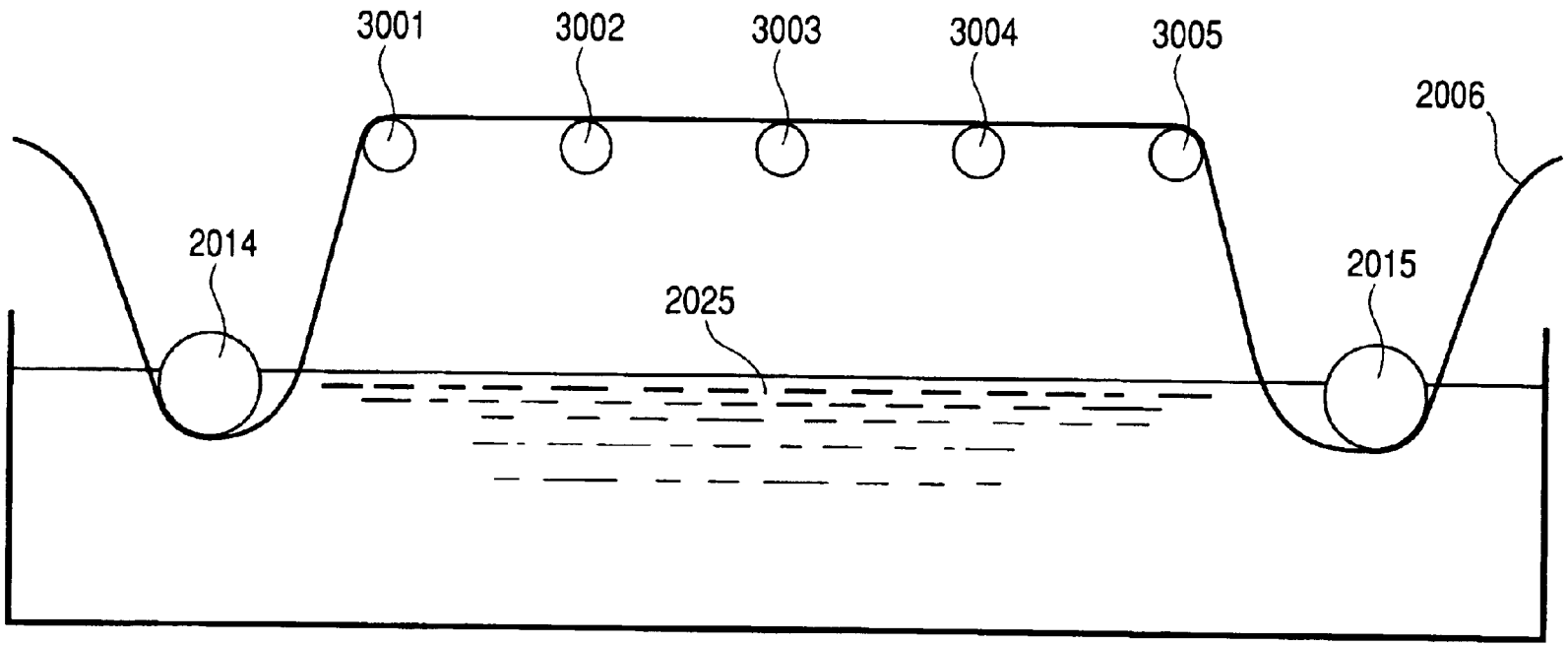
FIG. 12 is a schematic constitutional view illustrating a preferred embodiment of the apparatus and method of the present invention.

Above the first electrodeposition tank, there may be provided holding means for holding a long substrate. For example, as schematically shown in FIG. 12, a long substrate 2006 is held by hooks 3001–3005 provided above the first electrodeposition tank. For instance, when the film formation is stopped, the long substrate is not wound up but wound off excessively to be bent and the portion between rollers 2014 and 2015 is hung on the hooks 3001–3005 by human power or the like to hold the long substrate. The same technique applies to the second electrodeposition tank. The principal merit of this technique is that the maintenance of the inside of the electrodeposition baths such as exchange of electrodes (zinc plates; not shown in FIG. 12) is easy. However, when adopting this technique, it is difficult to bring a part in the vicinity of the rollers 2014 and 2015 of the long substrate into non-contact with the electrodeposition bath.

Figure 13:
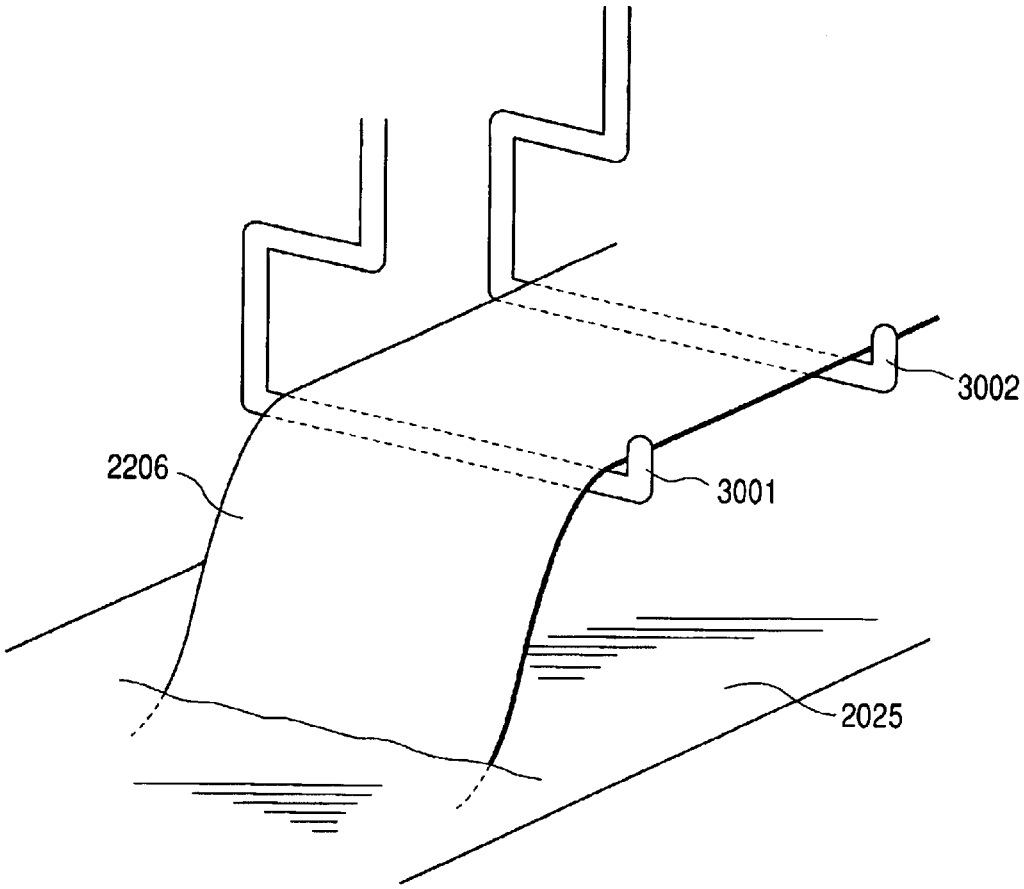
FIG. 13 is a schematic perspective view showing a part of the apparatus shown in FIG. 12.

FIG. 13 is a partial perspective view schematically showing the technique for holding the long substrate illustrated in FIG. 12.

In order to stir the electrodeposition bath to make uniform formation of the electrodeposition film, the system is so designed that air bubbles are jetted from a plurality of orifices bored in a first electrodeposition tank stirring air feed pipe 2062 installed at the bottom of the first electrodeposition bath holder tank 2065. As air, compressed air fed to a factory is taken in from a compressed-air intake opening 2182 and, through an electrodeposition bath stirring compressed-air pressure switch 2183 and in the direction shown by a compressed-air feed direction 2184, is passed through a compressed-air main valve 2185, a compressed-air flow meter 2186, a compressed-air regulator 2187, a compressed-air mist separator 2188, a compressed-air feed valve 2189, a compressed-air flexible pipe 2190, a compressed-air Insulating pipe 2191 and a compressed-air upstream-side control valve 2193 or a compressed-air downstream-side control valve 2192 in order, and is led to the first electrodeposition tank stirring air feed pipe 2062.

The film-deposited long substrate transported to the second electrodeposition tank 2116 through the electrodeposition tank-to-tank turn-back roller 2016 is subjected to deposition of a second electrodeposited film or to some treatment. Depending on the manner of use of the present apparatus, the second electrodeposited film may be the same as the first electrodeposited film and the first and second electrodeposited films may make up one film. Alternatively, the two layers may make up a stacked layer of two layers formed of the same material but endowed with different properties (e.g., a stacked layer of layers formed of the same zinc oxide but having different particle diameters), or a stacked layer of two layers having the same properties but formed of different properties (e.g., a stacked layer of a zinc indium layer as a transparent conductive layer and a zinc oxide layer), or a stacked layer of entirely different layers. Still alternatively, a low oxide may be deposited in the first electrodeposition tank 2066 and its oxidation-promoting treatment may be made in the second electrodeposition tank 2116, or a low oxide may be deposited in the first electrodeposition tank 2066 and its etching treatment may be made in the second electrodeposition tank 2116. Such combinations are possible. Accordingly, electrodeposition or treatment conditions such as electrodeposition bath, bath temperature, bath circulation quantity, electric-current density and stirring rate may be selected according to the corresponding purposes.

When electrodeposition or treatment time must be made different between the first electrodeposition tank 2066 and the second electrodeposition tank 2116, the time for which the long substrate 2006 is passed may be made different between the first electrodeposition tank 2066 and the second electrodeposition tank 2116. To make such time different, it may be regulated by making tank length different between the first electrodeposition tank 2066 and the second electrodeposition tank 2116, or by making the long substrate turn back.

Figure 5:
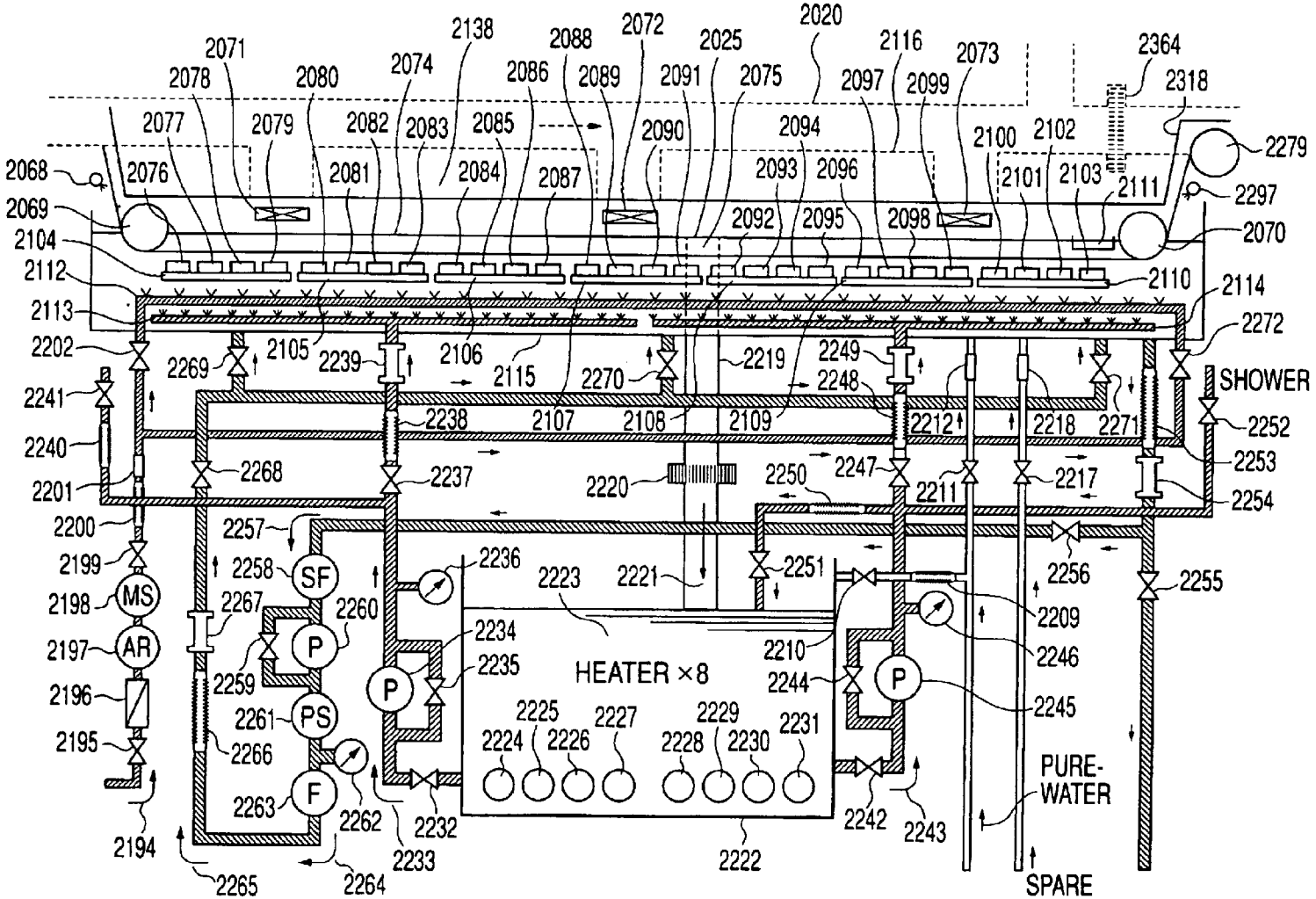
FIG. 5 is a schematic constitutional view showing a second electrodeposition tank and related units of the zinc oxide thin film forming apparatus of FIG. 2.

The second electrodeposition tank 2116 comprises, as shown in FIG. 5, a second electrodeposition bath holder tank 2115 which is not corrosive against the electrodeposition bath and can keep the temperature of the electrodeposition bath, and in that tank a temperature-controlled electrodeposition bath is so held as to have a second electrodeposition bath surface 2074 The position of this bath surface is realized by an over flow attributable to a partition plate provided inside the second electrodeposition bath holder tank 2115. The partition plate (not shown) is so installed that the electrodeposition bath is let fall toward the inner-part side by the whole second electrodeposition bath holder tank 2115. The overflowed electrodeposition bath collected in tub structure in a second electrodeposition tank overflow return opening 2075 comes to the second circulation tank 2222 through a second electrodeposition tank overflow return path 2219, where the bath is heated and is circulated again into the second electrodeposition bath holder tank 2115 from a second electrodeposition tank upstream circulation jet pipe 2113 and a second electrodeposition tank downstream circulation jet pipe 2114 to form an inflow of the electrodeposition bath in a quantity enough for prompting the overflow.

The film-deposited long substrate 2006 is passed through the inside of the second electrodeposition tank 2116 via the electrodeposition tank-to-tank turn-back roller 2016, a second electrodeposition tank approach roller 2069, a second electrodeposition tank withdrawal roller 2070 and a pure-water shower tank turn-back approach roller 2279. Between the second electrodeposition tank approach roller 2069 and the second electrodeposition tank withdrawal roller 2070, the surface side of the long substrate lies in the electrodeposition bath and faces twenty-four anodes 2076 to 2099. In actual electrodeposition, negative potential is applied to the long substrate and positive potential to the anodes, and electrodeposition electric current which causes electrochemical reaction concurrently is flowed across the both in the electrodeposition bath to effect electrodeposition.

In the apparatus shown in FIG. 2, the anodes in the second electrodeposition tank 2116 are four by four placed on seven anode stands 2104 to 2110. The anode stands are so structured that the respective anodes are placed thereon through insulating plates, and are so made that individual potential is applied from independent power sources. Also, the anode stands 2104 to 2110 have the function to keep distance between the long substrate 2006 and the anodes 2076 to 2103 in the electrodeposition bath. Accordingly, in usual cases, the anode stands 2104 to 2110 are so designed and produced that their height is adjustable to keep a predetermined distance between the both.

A second electrodeposition tank back-side film adhesion preventive electrode 2111 provided immediately before the second electrodeposition tank withdrawal roller 2070 is an anode for electrochemically removing any film deposited unwontedly in the bath on the back side of the long substrate on. This is materialized by bringing the second electrodeposition tank back-side film adhesion preventive electrode 2111 to a negative-side potential with respect to the long substrate. Whether or not the second electrodeposition tank back-side film adhesion preventive electrode 2111 has its effect actually is confirmable by visually observing that a film of the same materials as the film formed on the film-forming side of the long substrate is fast removed on and on, which adheres electrochemically to the back side, the side opposite to the film-forming side of the long substrate, because of come-around of an electric field.

On the film-deposited long substrate having passed the second electrodeposition tank withdrawal roller 2070 and having come out of the electrodeposition bath, the electrodeposition bath is sprayed from a second electrodeposition tank exit shower 2297 to prevent the film-formed surface from drying to cause unevenness. Also, a pure-water shower tank turn-back approach roller cover 2318 provided at a cross-over portion between the second electrodeposition tank 2116 and a pure-water shower tank 2360 entraps the vapor generated from the electrodeposition bath, to prevent the film-formed surface of the long substrate from drying. Still also, a pure-water shower tank entrance surface-side pure-water shower 2299 and a pure-water shower tank entrance back-side pure-water shower 2300 not only wash off the electrodeposition bath but also function likewise.

The second circulation tank 2222 functions to heat the electrodeposition bath fed into the second electrodeposition tank 2116 to keep its temperature and jet-circulate it. As described previously, the electrodeposition bath having overflowed from the second electrodeposition tank 2116 is collected at the overflow return opening 2075, then passes the overflow return path 2219, and comes to a second circulation tank heating and holding tank 2223 via a second electrodeposition tank overflow return path insulating flange 2220. Inside the second circulation tank heating and holding tank 2223, eight heaters 2224 to 2231 are provided, and are made to function when a room-temperature electrodeposition bath is initially heated or when the electrodeposition bath having come to have a low bath temperature as a result of circulation is again heated to keep the electrodeposition bath at a stated temperature.

Two circulation systems are connected to the second circulation tank heating and holding tank 2223. More specifically, they are a second electrodeposition tank upstream circulation flow-back system through which the electrodeposition bath returns from the second electrodeposition tank upstream circulation jet pipe 2113 to the second electrodeposition bath holder tank 2115 via an upstream circulation main valve 2232, an upstream circulation pump 2234, an upstream circulation valve 2237, an upstream circulation flexible pipe 2238 and an upstream circulation flange insulating pipe 2239, and a second electrodeposition tank downstream circulation flow-back system through which the electrodeposition bath returns from the second electrodeposition tank downstream circulation jet pipe 2114 to the second electrodeposition bath holder tank 2115 via a downstream circulation main valve 2242, a downstream circulation pump 2245, a downstream circulation valve 2247, a downstream circulation flexible pipe 2248 and a downstream circulation flange insulating pipe 2249. The electrodeposition bath which returns from the upstream circulation jet pipe 2113 and downstream circulation jet pipe 2114 to the second electrodeposition tank 2116 is circulated so that the electrodeposition bath can effectively be exchanged in the second electrodeposition bath holder tank 2115, and is circulated as jets from the upstream circulation jet pipe 2113 and downstream circulation jet pipe 2114 provided at a lower part of the second electrodeposition bath holder tank 2115, through orifices bored in their respective jet pipes. The amount of flowing back of each circulation flow-back system is chiefly controlled by the degree at which the upstream circulation valve 2237 or downstream circulation valve 2247 is opened or closed, and is more delicately controllable by an upstream circulation pump by-pass valve 2235 or a downstream circulation pump by-pass valve 2244, which is provided in a by-pass system connected by by-passing the upstream circulation pump 2234 or downstream circulation pump 2245 at its exit and entrance. Such by-pass systems also have the function to prevent any cavitation in the pumps when the electrodeposition bath is circulated in a small quantity or has a bath temperature very close to the boiling point. The cavitation which, as also stated in the description of the first electrodeposition tank 2066, may make the bath solution boil to vaporize to make any liquid unfeedable may shorten the lifetime of pumps greatly.

When orifices are bored in the second electrodeposition tank upstream circulation jet pipe 2113 and second electrodeposition tank downstream circulation jet pipe 2114 to form jets, the amount of flowing back almost depends on the pressure of the solution returned to the upstream circulation jet pipe 2113 and downstream circulation jet pipe 2114. To know this pressure, a second electrodeposition tank electrodeposition bath upstream circulation pressure gauge 2236 and a second electrodeposition tank electrodeposition bath downstream circulation pressure gauge 2246 are provided so that the balance of the amount of flowing back can be known by these pressure gauges. Stated accurately, the quantity of flowed-back bath solution jetted from the orifices follows the Bernouilli theorem. When, however, the orifices bored in the jet pipes are several millimeters in diameter, the jet quantity can be made substantially constant over the whole second electrodeposition tank upstream circulation jet pipe 2113 or second electrodeposition tank downstream circulation jet pipe 2114. When also the amount of flowing back is sufficiently large, the bath can be exchanged very smoothly. Hence, even when the second electrodeposition tank 2116 is fairly long, making bath concentration uniform and making temperature uniform can effectively be achieved. As a matter of course, the second electrodeposition tank overflow return path 2219 should have a diameter large enough for the bath to be flowed back in a sufficient quantity.

The upstream circulation flexible pipe 2238 and the downstream circulation flexible pipe 2248, which are provided in the respective circulation flow-back systems, absorb any strain of piping systems, and are effective especially when flange insulating piping which tends to have an insufficient mechanical strength is used. The upstream circulation flange insulating pipe 2239 and the downstream circulation flange insulating pipe 2249, which are provided in the respective circulation flow-back systems, make the second circulation tank 2222 and second electrodeposition tank 2116 electrically float together with the second electrodeposition tank overflow return path insulating flange 2220, provided in the course of the second electrodeposition tank overflow return path 2219. This is based on the present inventors' findings that the breaking off of formation of unauthorized electric-current paths, i.e., the prevention of stray electric current leads to stable and effective procedure of the electrochemical film-forming reaction that utilizes electrodeposition electric current.

The other circulation flow-back system is provided with a by-pass flow-back system which returns directly to the second circulation tank heating and holding tank 2223 and comprises a by-pass circulation flexible pipe 2250 and a by-pass circulation valve 2251. This is used when the bath should be circulated without circulating the bath solution to the second electrodeposition tank 2116, e.g., when the bath temperature is raised from room temperature to a stated temperature. Both the circulation flow-back systems extending from the second circulation tank 2222 are also provided with two solution feed systems, one of which send the electrodeposition bath to a second electrodeposition tank entrance shower 2068 which sprays the bath on the film-deposited long substrate immediately before it reaches the second electrodeposition tank approach roller 2069, and the other of which send the electrodeposition bath to a second electrodeposition tank exit shower 2297 which sprays the bath on the film-deposited long substrate having passed the second electrodeposition tank withdrawal roller 2075 to have come out of the electrodeposition bath. The former extends to the second electrodeposition tank entrance shower 2068 via a second electrodeposition tank entrance shower valve 2241, and the latter extends to the second electrodeposition tank exit shower 2297 via a second electrodeposition tank exit shower valve 2252. The amount of the electrodeposition solution sprayed from the entrance shower 2068 is regulated by controlling the degree of opening or closing the entrance shower valve 2241, and the amount of the electrodeposition solution sprayed from the exit shower 2297 is regulated by controlling the degree of opening or closing the exit shower valve 2252.

The second circulation tank heating and holding tank 2223 is actually provided with a cover to provide a structure that can prevent the bath from vaporizing to lose water. When the bath has a high temperature, the cover also comes to have a high temperature, and hence it should be taken into consideration to, e.g., attach a heat insulation material. This is necessary in view of the safety of operation.

In order to remove particles floating in the second electrodeposition tank electrodeposition bath, a filter circulation system is provided. A filter circulation system for the second electrodeposition tank 2116 consists of a filter circulation return flexible pipe 2253, a filter circulation return flange insulating pipe 2254, a filter circulation main valve 2256, a filter circulation suction filter 2258, a filter circulation pump 2260, a filter circulation pump by-pass valve 2259, a filter circulation pressure switch 2261, a filter circulation pressure gauge 2262, a filter circulation filter 2263, a filter circulation flexible pipe 2266, a filter circulation flange insulating pipe 2267, a filter circulation valve 2268, a filter circulation system electrodeposition bath upstream return valve 2269, a filter circulation system electrodeposition bath midstream return valve 2270 and a filter circulation system electrodeposition bath downstream return valve 2271. Through this course, the electrodeposition bath flows in the direction of second electrodeposition tank filter circulation directions 2257, 2264 and 2265. The particles to be removed may originate from powder brought in from the outside of the system or may be formed on the electrode surface or in the bath, depending on electrodeposition reaction. Minimum size of the particles to be removed depends on the filter size of the filter circulation filter 2263.

The filter circulation return flexible pipe 2253 and the filter circulation flexible pipe 2266 are pipes for absorbing any strain of piping systems to minimize any liquid leakage from pipe-connected portions and also protect the insulating pipe inferior in mechanical strength so that the constituent parts of the circulation system which includes pumps can be disposed at a greater degree of freedom. The filter circulation return flange insulating pipe 2254 and the filter circulation flange insulating pipe 2267 are provided so that the second electrodeposition bath holder tank 2115 set floating from the ground earth can be made to float electrically to prevent it from falling to the ground earth. The filter circulation suction filter 2258 is a wire cloth like a "tea strainer", so to speak, and is a filter for removing large foreign matter so as to protect the subsequent filter circulation pump 2260 and filter circulation filter 2263. The filter circulation filter 2263 is the leading part of this circulation system, and is a filter for removing any particles having mixed or occurred in the electrodeposition bath. The circulation flow rate of the electrodeposition bath in this circulation system is micro-adjusted primarily by the filter circulation valve 2268, and secondarily by the filter circulation pump by-pass valve 2259, provided in parallel to the filter circulation pump 2260. The filter circulation pressure gauge 2262 is provided in order to catch the circulation flow rate to be adjusted by these valves. The filter circulation pump by-pass valve 2259 not only micro-adjusts the flow rate but also prevents the filter circulation pump 2260 from breaking because of any cavitation which may occur when the whole filter circulation flow rate is reduced.

The electrodeposition bath can be transferred to a second waste-solution tank 2274 through the filter circulation return flange insulating pipe 2254 via a second electrodeposition tank drain valve 2255. This transfer is made when the electrodeposition bath is replaced, when the apparatus is put to maintenance work and also on occasion of emergency. The electrodeposition bath as waste solution to be transferred is fallen by gravity-drop into a second waste-solution tank waste-solution holder tank 2273. For the purpose of maintenance work or emergency measures, the second waste-solution tank waste-solution holder tank 2273 may preferably have a capacity large enough to store the total bath volume in the second electrodeposition tank 2116 and the second circulation tank 2222. The second waste-solution tank waste-solution holder tank 2273 is provided with a top cover 2278 and, in order to make the gravity-drop transfer of the electrodeposition bath effective, it is provided with an air vent 2276 and a second waste-solution tank air vent valve 2275. The electrodeposition bath which has temporarily been fallen into the second waste-solution tank waste-solution holder tank 2273 is, after its temperature has lowered, sent out through a waste-solution drainage valve 2180 for drainage treatment on the side of a building, or collected in a steel drum (not shown) through a waste-solution collection valve 2181, a waste-solution collection main valve 2175, a waste-solution collection main suction filter 2176 and a waste-solution collection pump 2177 so as to be put to appropriate disposal. Before the collection or treatment, the waste solution may also be diluted with water or treated with chemicals in the waste-solution holder tank 2273.

In order to stir the electrodeposition bath to make uniform formation of the electrodeposition film, the system is so designed that air bubbles are jetted from a plurality of orifices bored in a second electrodeposition tank stirring air feed pipe 2112 installed at the bottom of the second electrodeposition bath holder tank 2115. As air, compressed air fed to a factory is taken in from a compressed-air intake opening 2182 and, through an electrodeposition bath stirring compressed-air pressure switch 2183 and in the direction shown by a compressed-air feed direction 2194, is passed through a compressed-air main valve 2195, a compressed-air flow meter 2196, a compressed-air regulator 2197, a compressed-air mist separator 2198, a compressed-air feed valve 2199, a compressed-air flexible pipe 2220, a compressed-air insulating pipe 2201 and a compressed-air upstream-side control valve 2202 or a compressed-air downstream-side control valve 2272 in order, and is led to the second electrodeposition tank stirring air feed pipe 2112.

Figure 6:
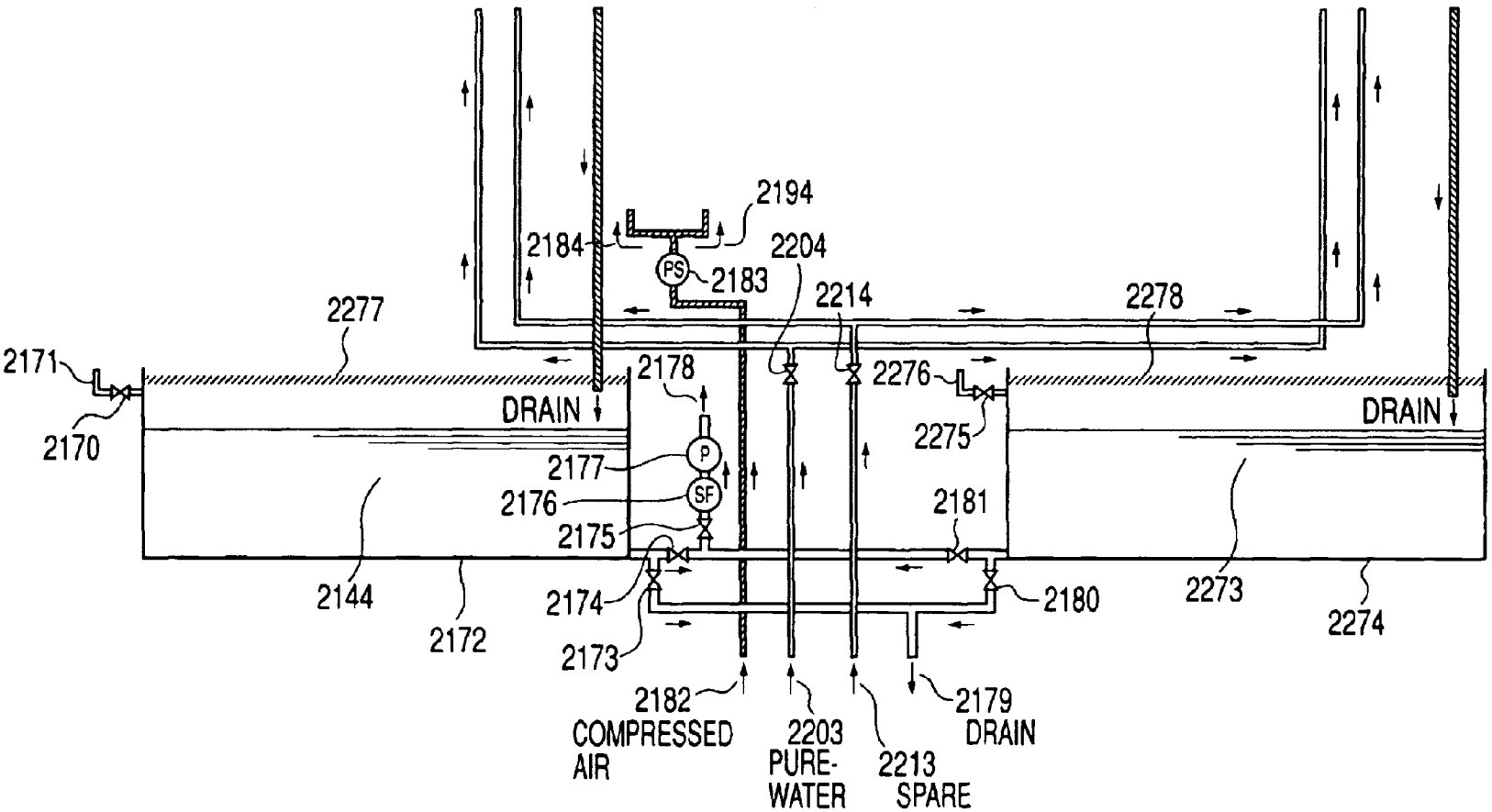
FIG. 6 is a schematic constitutional view showing a first waste-solution tank and a second waste-solution tank of the zinc oxide thin film forming apparatus of FIG. 2.

In the first electrodeposition tank 2066 and second electrodeposition tank 2116, as shown in FIG. 6 a spare (or extra) feed system is installed so that an extra liquid or gas can be fed in. Liquid or gas having entered from an electrodeposition tank spare feed inlet 2213 is fed via an electrodeposition tank spare feed valve 2214, into the first electrodeposition tank 2066 through a first electrodeposition tank spare feed valve 2215 and a first electrodeposition tank spare feed insulating pipe 2216, and also into the second electrodeposition tank 2116 through a second electrodeposition tank spare feed valve 2217 and a second electrodeposition tank spare feed insulating pipe 2218. In the spare feed system, those having the highest possibility of being fed in are retaining agents or replenishing chemicals which are used for keeping the ability of the bath constant for a long time. In some cases, they may be gases to be dissolved in the bath or acids capable of removing the particles.

Figure 7:
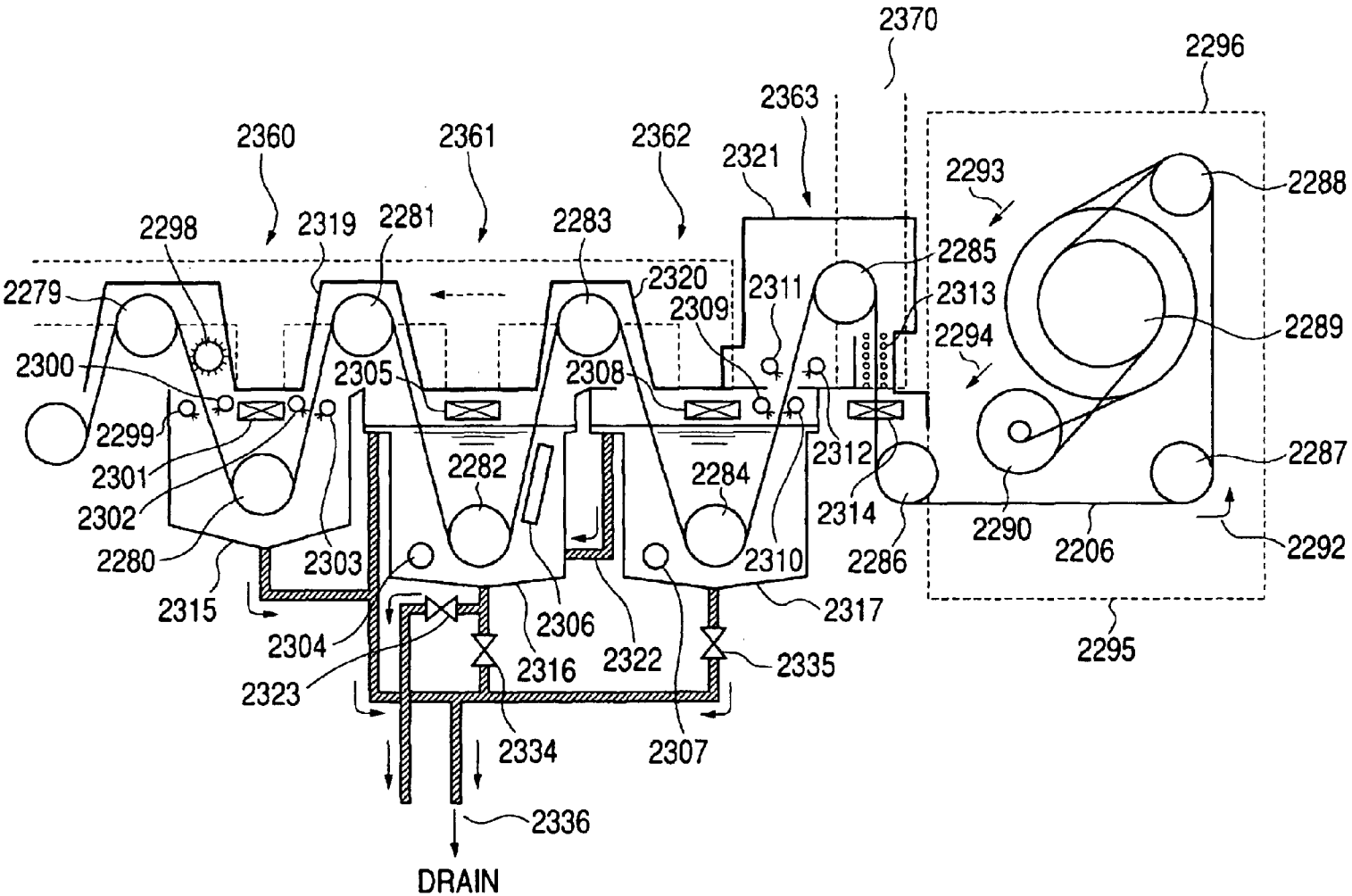
FIG. 7 is a schematic constitutional view showing a rinsing tank and a wind-up unit of the zinc oxide thin film forming apparatus of FIG. 2.
Figure 8:
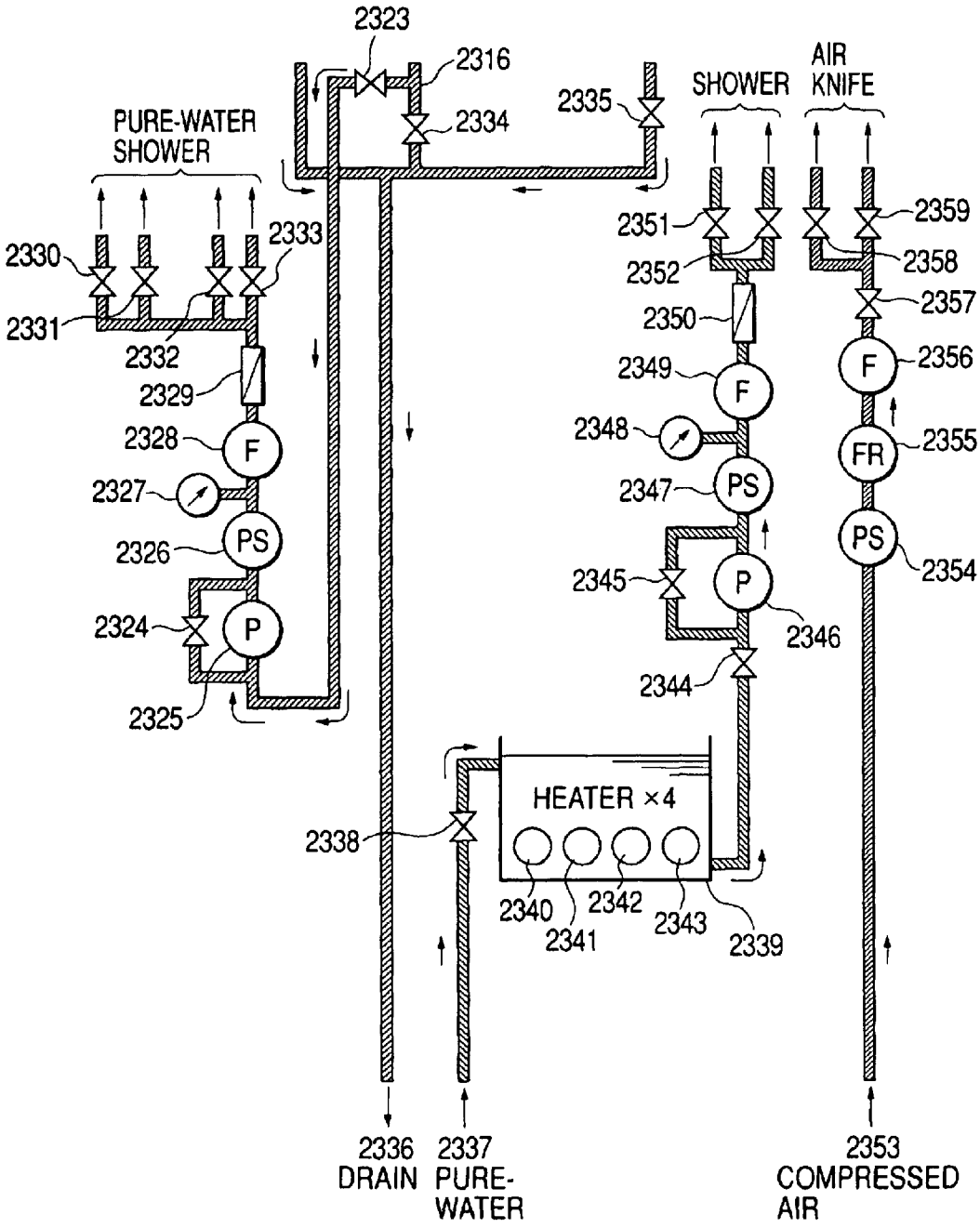
FIG. 8 is a schematic constitutional view showing a pure-water heating tank of the zinc oxide thin film forming apparatus of FIG. 2.
Figure 9:
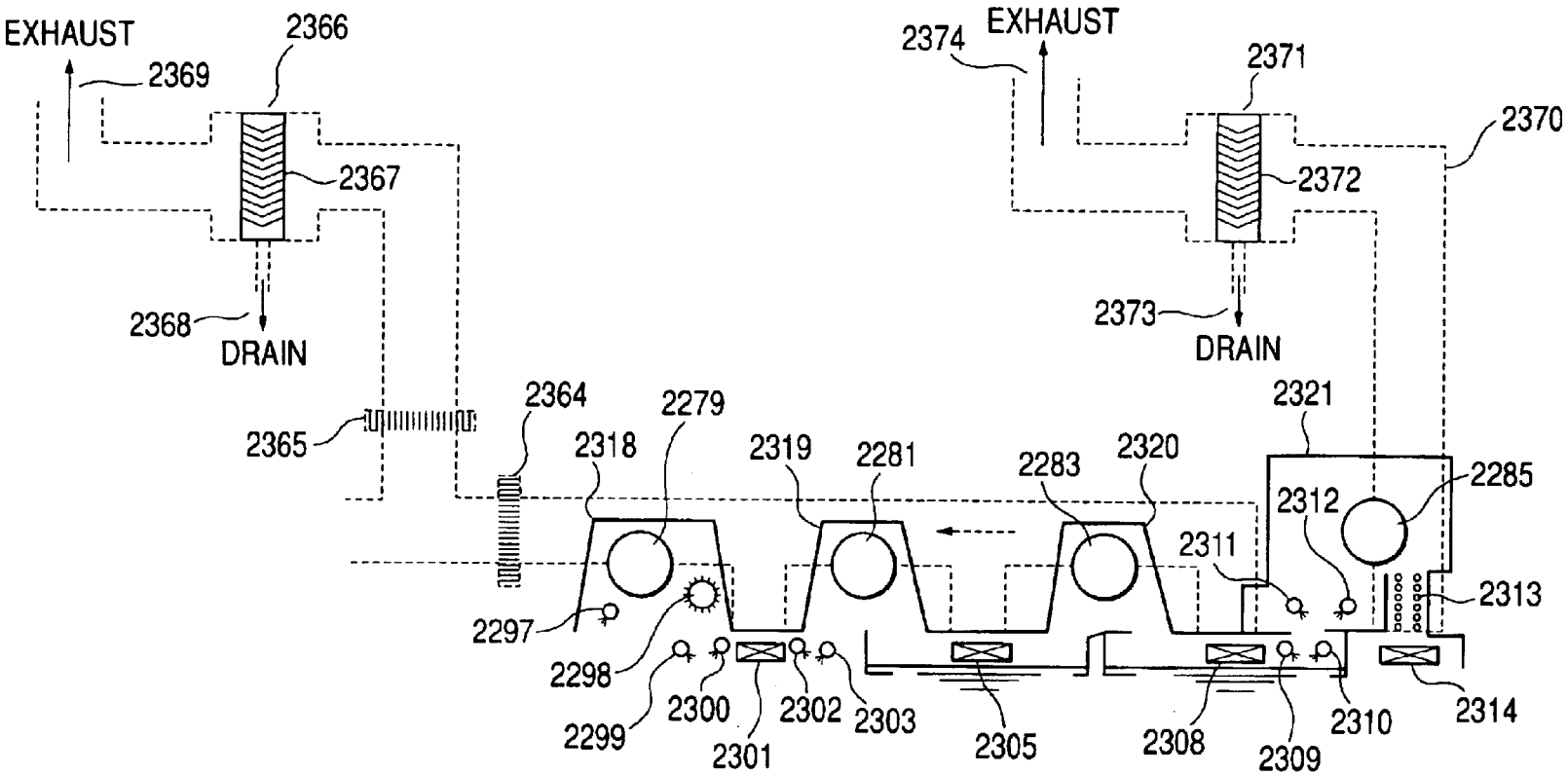
FIG. 9 is a schematic constitutional view showing an exhaust duct system of the zinc oxide thin film forming apparatus of FIG. 2.

The rinsing is carried out through three stages of a pure-water shower tank, a first hot-water tank and a second hot-water tank as shown in FIG. 7. Its system is so constructed that heated pure water is fed to the second hot-water tank, and its waste liquor is used in the first hot-water tank, and further its waste liquor is used in the pure-water shower tank 2360. Thus, after the electrodeposition in the electrodeposition tanks has been completed, the film-deposited long substrate is washed on with water having purities stepwise made higher. This constitution assures that the water in the second hot-water tank always has a conductivity of 1 $\mu$S/cm or less.

This pure water is fed to a second hot-water tank exit back-side pure-water shower 2309 and a second hot-water tank exit surface-side pure-water shower 2310. The pure water to be fed is temporarily stored in a pure-water heating tank 2339 from a water washing system pure-water inlet 2337 through a water washing system pure-water feed main valve 2338, then heated to a predetermined temperature by means of pure-water heaters 2340 to 2343, and then passed through a pure-water delivery valve 2344, a pure-water delivery pump 2346, a tank pressure switch 2347, a cartridge type filter 2349 and a flow meter 2350. Then the pure water is on the one hand led through a second hot-water tank exit back-side shower valve 2351 to the second hot-water tank exit back-side pure-water shower 2309 nnd on the other hand led through a second hot-water tank exit surface-side shower valve 2352 to the second hot-water tank exit surface-side pure-water shower 2310. The heating is in order to improve cleaning effect. The pure water fed to the showers and collected in a second hot-water tank hot-water holding tank 2317 forms a pure-water rinsing bath, and the film-deposited long substrate is washed with still water. In the second hot-water tank 2362, a hot-water warming heater 2307 is provided so that the temperature of the pure water does not drop.

To the first hot-water tank 2361, pure water having overflowed the second hot-water tank hot-water holding tank 2317 is fed from the second hot-water tank 2362 via a hot-water tank-to-tank connecting pipe 2322. To the first hot-water tank 2361, like the second hot-water tank 2362, a first hot-water tank hot-water warming heater 2304 is provided so that the temperature of the pure water can be maintained. To the first hot-water tank 2361, an ultrasonic wave source 2306 is further provided so that any stains on the film-deposited long substrate surface can positively removed between a first hot-water tank roller 2282 and a second hot-water tank turn-back approach roller 2283.

In the pure-water shower tank 2360, pure water from a first hot-water tank hot-water holding tank 2316 is, subsequent to a pure-water shower feed main valve 2323, sent through a pure-water shower feed pump 2325, a pure-water shower feed pressure switch 2326, a pure-water shower feed cartridge type filter 2328 and a pure-water shower feed flow meter 2329, and is further sent from a pure-water shower tank entrance surface-side pure-water shower valve 2330 to a pure-water shower tank entrance surface-side pure-water shower 2299, from a pure-water shower tank entrance back-side pure-water shower valve 2331 to a pure-water shower tank entrance back-side pure-water shower 2300, from a pure-water shower tank exit back-side pure-water shower valve 2332 to a pure-water shower tank exit back-side pure-water shower 2302, and from a pure-water shower tank exit surface-side pure-water shower valve 2333 to a pure-water shower tank exit surface-side pure-water shower 2303, thus washing shower streams are applied to the respective film-deposited long substrate back side and surface side at the entrance and exit of the pure-water shower tank 2360. The water having been served on showering is received in a pure-water shower tank receiving tank 2315, and, as it is, joined with part of the water in the first hot-water tank hot-water holding tank 2316 and second hot-water tank hot-water holding tank 2317, which is then discarded to a water washing system drainage 2336. Usually, the water having been served on washing contains ions and others, and must be subjected to given treatment.

In the pure-water shower tank 2360, first hot-water tank 2361 and second hot-water tank 2362, the film-deposited long substrate is forwarded to a pure-water shower tank return-back approach roller 2279, a pure-water shower tank roller 2280, a first hot-water tank return-back approach roller 2281, a first hot-water tank return-back approach roller 2281, a first hot-water tank roller 2282, a second hot-water tank return-back approach roller 2283, a second hot-water tank roller 2284 and a drying-section return-back roller 2285. Immediately at the rear of the pure-water shower tank return-back approach roller 2279, a pure-water shower tank back-side brush 2298 is provided so that any relatively large particles or weakly adherent unauthorized products having adhered to the film-deposited long substrate back side can be removed.

The film-deposited long substrate 2006 having come to the drying section 2363 is first hydro-extracted with a drying-section entrance back-side air knife 2311 and a drying-section entrance back-side air knife 2312. To the air-knives, air is fed through the course consisting of a drying-system compressed-air feed inlet 2353, a drying-system compressed-air pressure switch 2354, a drying-system compressed-air filter regulator 2355, a drying-system compressed-air mist separator 2356, a drying-system compressed-air feed valve 2357 and then a drying-section entrance back-side air knife valve 2358 or a drying-section entrance surface-side air knife valve 2359. The air fed to the drying section 2363 may cause a difficulty especially if it contains water drops or the like. Accordingly, the role of the drying-system compressed-air mist separator 2356 is important.

In the course where the film-deposited long substrate is transported from the drying-section return-back roller 2285 to a wind-up unit approach roller 2286, it is dried by radiation heat of IR lamps arranged there. As long as the IR lamps provide sufficient radiation heat, no difficulty may occur even when the long substrate 2006 is put into a vacuum apparatus such as a CVD apparatus after the electrodeposition film has been formed thereon. At the time of drying, the hydro-extraction causes fog and the IR lamp radiation causes water vapor. Accordingly, it is indispensable to provide a drying-section exhaust vent 2314 communicating with an exhaust duct. The water vapor collected in a drying-system exhaust duct 2370 is almost all returned to water through a drying-system condenser 2371, which is then discarded to a drying-system condenser water drainage 2373 and is partly discarded to drying-system exhaust 2374. When the water vapor contains any harmful gases, it should be driven off after given treatment.

In the wind-up unit 2296, the film-deposited long substrate 2006 is brought to pass an approach roller 2286, a direction change roller 2287, a wind-up regulation roller 2288 in order, and is successively wound up in a coil on a film-deposited long substrate wind-up bobbin 2289. When it is necessary to protect the deposited film, an interleaf is wound off from an interleaf wind-off bobbin 2290 and is rolled up on the film-deposited long substrate, as shown in FIG. 7. The direction in which the film-deposited long substrate 2006 is transported is shown by an arrow 2292, the direction in which the film-deposited long substrate wind-up bobbin 2289 is rotated is shown by an arrow 2293, and the direction in which the interleaf wind-off bobbin 2290 is wound up is shown by an arrow 2294. FIG. 7 shows that the film-deposited long substrate 2006 wound up on the wind-up bobbin 2289 and the interleaf wound off from the interleaf wind-off bobbin 2290 are not interfered with each other at the transport-starting position and the transport-ending position. For the purpose of dust-proofing, the whole wind-up unit is so structured as to be covered with a clean booth 2295 making use of a HEPA filter and a down flow.

In the unit shown in FIG. 7, the direction change roller 2287 is provided with the function to correct any meandering of the long substrate 2006. In accordance with signals from a meander detector provided between the direction change roller 2287 and the wind-up regulation roller 2288, the direction change roller 2287 is made to swing by a hydraulic servo around a shaft set on the side of the approach roller 2286, whereby any meandering motion can be corrected. The direction change roller 2287 is controlled by the movement of the roller approximately toward this side or the inner-part side, and the direction of its movement is opposite to the direction of detection of the meandering of the long substrate from the meander detector. Gain of the servo depends on the long substrate transport speed, and is commonly not required to be large. Even when a long substrate of hundreds of meters in length is wound up, its edge faces can be made even at a precision on a submilllmetric order.

Use of the electrodeposition bath and hot water at a temperature higher than room temperature generates water vapor necessarily. In particular, their use at a temperature higher than 80° C. generates water vapor considerably. Water vapor generated from the bath surface in the tank may gather on the bath surface in the tank to come to spout strongly from gaps of the apparatus or to become released in a large quantity when the cover is opened, or it may flow down in water drops from gaps of the apparatus, to worsen operational environment of the apparatus. Accordingly, the water vapor may preferably be discharged forcedly by suction. Water vapor is collected to the exhaust duct 2020 for electrodeposition tank and water washing system via an upstream exhaust vent 2021, a midstream exhaust vent 2022 and a downstream exhaust vent 2023 of the first electrodeposition tank 2066 and also an upstream exhaust vent 2071, a midstream exhaust vent 2072 and a downstream exhaust vent 2073 of the second electrodeposition tank 2116, an exhaust vent 2301 of the pure-water shower tank 2360, an exhaust vent 2305 of the first hot-water tank 2361 and an exhaust vent 2308 of the second hot-water tank 2362, and is passed through insulating flanges (2364, 2365) and almost all returned to water through an electrodeposition water washing system exhaust duct condenser 2366, which is then discarded to a condenser water drainage 2368 and is partly discarded to electrodeposition water washing system exhaust 2369. When the water vapor contains any harmful gases, it should be driven off after given treatment.

In the apparatus shown in FIG. 2, the exhaust duct 2020 is constituted of stainless steel. Accordingly, In order to bring the bath holder tank 2065 of the first electrodeposition tank 2066 and the bath holder tank 2115 of the second electrodeposition tank 2116 from the ground earth to the float potential, an electrodeposition water washing system exhaust duct key insulating flange 2365 and an electrodeposition water washing system exhaust duct water-washing-side insulating flange 2364 are provided so that the both tanks are electrically separated.

(Deposition of Zinc, Zinc Hydroxide or the Like)

When zinc metal and SUS430 are dipped in an aqueous zinc nitrate bath and end portions of the both metals are connected to each other with a lead, it is confirmed that zinc metal is deposited (precipitated) on the surface of the SUS430. This is believed to be attributable to a local cell or local potential. Further, the solubility of zinc nitrate in a zinc nitrate bath decrease as the temperature decreases.

(Conductive Long Substrate)

As materials for the conductive long substrate used in the apparatus of the invention, any materials are usable as long as they ensure electrical conduction to their film-forming surfaces and are not attacked by the electrodeposition bath, and metals such as stainless steel (SUS), Al, Ag, Cu, Fe, etc. may be used. Also usable are PET (polyethylene terephthalate) films coated with metals. Of these, SUS stainless steel is advantageous for the long substrate in order to carry out a device (element) fabrication process in a post step.

As the SUS stainless steel, either of non-magnetic SUS stainless steel and magnetic SUS stainless steel may be used. The former is typified by SUS 304 stainless steel, which has so good abrasive properties that it can be made to have a mirror surface of about 0.1 s. The latter is typified by ferrite type SUS 430 stainless steel, which is effectively usable when transported by utilizing magnetic force.

The substrate may have a smooth surface or a rough surface. Surface properties can be changed by changing the type of a pressure roller in a SUS stainless steel rolling process. SUS stainless steel called BA has a surface close to mirror surface, and the one called 2D has a remarkably uneven surface. Any of the surfaces may have conspicuous hollows of microscopic order in observation by SEM (scanning electron microscopy). As substrates for solar cells, solar-cell characteristics greatly reflect surfaces having an uneven structure of microscopic order, in both a good direction and a bad direction, rather than those having a greatly undulated unevenness.

On the substrate, a film of different conductive material such as Ag or Al may further be preliminarily formed, which may be selected according to the purpose of electrodeposition. In some cases, forming in advance a very thin layer of zinc oxide by a different process such as sputtering is preferred because deposition rate in electrodeposition can stably be improved. Certainly, the electrodeposition has an advantage that it is economical, but it is also advantageous to use two processes in combination as long as the cost reduction can be achieved in total even when a more or less expensive process is additionally employed. In the specification and claims, the description is made on the assumption that the above mentioned conductive material or thin layer constitute a part of the conductive substrate, unless otherwise noted.

Incidentally, the effect of the invention becomes more prominent when the substrate contains a metal component that can easily be dissolved in an electrodeposition bath, for example Ag.

(Rinsing)

In order to produce zinc oxide thin films as well as photovoltaic elements using zinc oxide thin films with high reliability, sufficient rinsing is indispensable. Further, the present inventors have reported in Japanese Patent Application Laid-Open No. 2000-173969 that making the conductivity of pure water 1 $\mu$S/cm or less makes it possible to provide zinc oxide thin films of high reliability.

(Filter)

Filters are necessary for intentionally removing from the bath solution system the powder generated in the system, and the size of soil remaining finally on the film as formed on the long substrate to be wound up depends on the filter size. Therefore, the necessary filter size is determined based on the characteristics necessary for the film.

EXAMPLES

The present invention will be described below in greater detail by giving Examples. The present invention is by no means limited to these Examples.

Example 1

Figure 11:
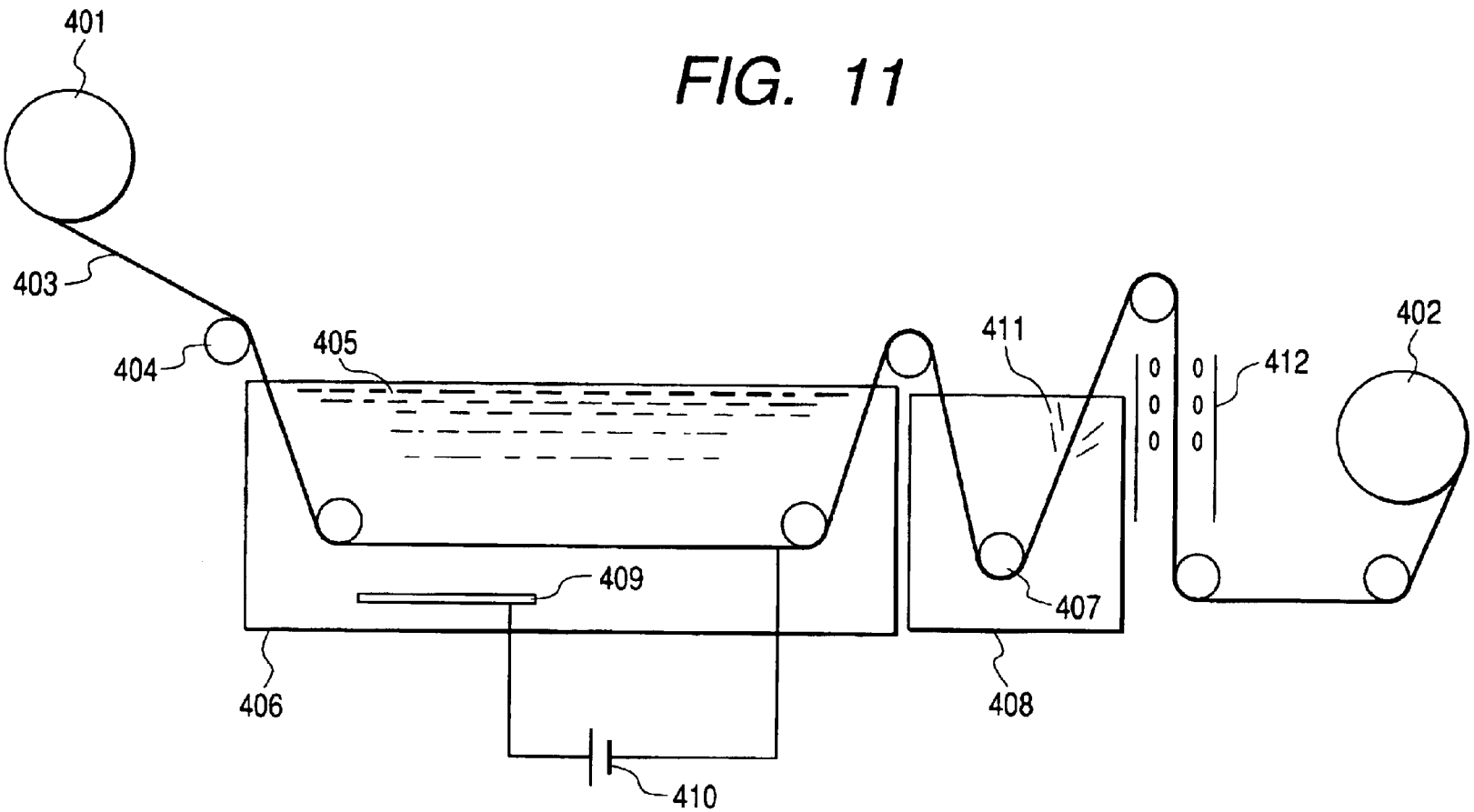
FIG. 11 is a schematic constitutional view showing a roll-to-roll system apparatus of Example 1 of the present invention.

A roll-to-roll experimental apparatus shown in FIG. 11 was used to make experiment. In FIG. 11, reference numeral 401 denotes a wind-off roller, 402 a a wind-up roller, 403 a roll-shaped support, 404 a transport roller, 405 a zinc oxide layer forming bath, 406 a zinc oxide layer forming tank, 407 a water washing bath, 408 a water washing tank, 409 an opposing electrode, 410 a power source, 411 a water washing shower, and 412 a drying furnace. On SUS 430 BA stainless steel sheet wound into a roll, previously aluminum was deposited in 1,000 Å thickness by means of a roll-adapted DC magnetron sputtering apparatus and zinc oxide was deposited in thin film thereon in 2,000 Å thickness by means of a like roll-adapted DC magnetron sputtering apparatus to obtain a roll-shaped support 403 and a zinc oxide film 103 was formed on the support. The roll-shaped support 403 was wound off from the wind-off roller 401, and was transported to the zinc oxide layer forming tank 406 through the transport roller 404. The zinc oxide layer forming bath 405 contained 0.2 mol/L of zinc nitrate and 1.0 g/L of dextrin, and liquid circulation means was disposed in order to stir the bath. The bath was kept at a temperature of 80° C. The opposing electrode 409 was used as the positive-side electrode, where electric current of 5.0 mA/cm$^2$ (0.5 A/cm$^2$) was flowed across the electrode and the wound-off roll substrate 403 to carry out electrodeposition. After the film was formed successively for 5 hours at a transporting speed of 1270 mm/min, the energization and the transportation were stopped.

Thereafter, the bath was pumped up with an electric pump such that the water level of the bath was lower than the long substrate. After the stopping of the electrodeposition apparatus for 18 hours, the pumped bath was returned to the zinc oxide layer forming tank 406, then the bath was heated to a temperature of 80° C., then the opposing electrode 409 was used as the positive-side electrode, where electric current of 5.0 mA/cm$^2$ (0.5 A/cm$^2$) was flowed across the electrode and the wound-off substrate 403 to carry out electrodeposition. At this time, the conductivity of the water inside the rinsing tank as measured by a conductometric meter (trade name SC-82, mfd. by Yokokawa Denki) was 0.9 $\mu$S/cm.

After a sample was cut out from the formed substrate and visually observed within a range of 355 mm×300 mm, the film thickness distribution in the width direction was measured at the five points of the center, both ends, and middles between the center and the both ends based on the waveform of the optical characteristics with an analyzer (trade name V-570, mfd. by Nihon Bunko Co., Ltd.) according to the optical interference method, and the number of abnormal growths within a range of 10 mm×10 mm was counted by observation with an SEM (trade name S-4500, mfd. by Hitachi, Ltd.). Further, the sample was left to stand for 1000 hours in an atmosphere of 85° C. temperature and 85% relative humidity, and then subjected to the cross cut test (JIS K5400 8.5.2). The results are shown in Table 1.

Example 2

After a film was formed successively for 5 hours at a transporting speed of 1270 mm/min. the energization and the transportation were stopped. Thereafter, a sample was prepared in the same manner as in Example 1 except that the bath was pumped up with an electric pump such that the water level of the bath was lower than the zinc (opposing electrode 409). At this time, the conductivity of the water inside the rinsing tank as measured by a conductometric meter (trade name SC-82, mfd. by Yokokawa Denki) was 0.7 μS/cm.

After the sample was cut out from the formed substrate and visually observed within a range of 355 mm×300 mm, the film thickness distribution in the width direction was measured at the five points of the center, both ends, and middles between the center and the both ends based on the waveform of the optical characteristics with an analyzer (trade name V-570, mfd. by Nihon Bunko Co., Ltd.) according to the optical interference method, and the number of abnormal growths within a range of 10 mm×10 mm was counted by observation with an SEM (trade name S-4500, mfd. by Hitachi, Ltd.). Further, the sample was left to stand for 1000 hours in an atmosphere of 85° C. temperature and 85% relative humidity, and then subjected to the cross cut test (JIS K5400 8.5.2). The results are shown in Table 1.

Example 3

After a film was formed successively for 5 hours at a transporting speed of 1270 mm/min, the energization and the transportation were stopped. Then, the bath was pumped up with an electric pump such that the water level of the bath was lower than the zinc (opposing electrode 409). Thereafter, a sample was prepared in the same manner as in Example 1 except that the electrodeposition apparatus was stopped for 180 hours. At this time, the conductivity of the water inside the rinsing tank as measured by a conductometric meter (trade name SC-82, mfd. by Yokokawa Denki) was 0.7 μS/cm.

After the sample was cut out from the formed substrate and visually observed within a range of 355 mm×300 mm, the film thickness distribution in the width direction was measured at the five points of the center, both ends, and middles between the center and the both ends based on the waveform of the optical characteristics with an analyzer (trade name V-570, mfd. by Nihon Bunko Co., Ltd.) according to the optical interference method, and the number of abnormal growths within a range of 10 mm×10 mm was counted by observation with an SEM (trade name S-4500. mfd. by Hitachi, Ltd.). Further, the sample was left to stand for 1000 hours in an atmosphere of 85° C. temperature and 85% relative humidity, and then subjected to the cross cut test (JIS K5400 8.5.2). The results are shown in Table 1.

Comparative Example 1

After a film was formed successively for 5 hours at a transporting speed of 1270 mm/min, the energization and the transportation were stopped.

Then, a sample was prepared in the same manner as in Example 1 except that the water level of the bath was kept unchanged. At this time, the conductivity of the water inside the rinsing tank as measured by a conductometric meter (trade name SC-82, mfd. by Yokokawa Denki) was 3.5 μS/cm.

After the sample was cut out from the formed substrate and visually observed within a range of 355 mm×300 mm, the film thickness distribution In the width direction was measured at the five points of the center, both ends, and middles between the center and the both ends based on the waveform of the optical characteristics with an analyzer (trade name V-570, mfd. by Nihon Bunko Co., Ltd.) according to the optical interference method, and the number of abnormal growths within a range of 10 mm×10 mm was counted by observation with an SEM (trade name S-4500, mfd. by Hitachi, Ltd.). Further, the sample was left to stand for 1000 hours in an atmosphere of 85° C. temperature and 85% relative humidity, and then subjected to the cross cut test (JIS K5400 8.5.2). The results are shown in Table 1.

Comparative Example 2

After a film was formed successively for 5 hours at a transporting speed of 1270 mm/min, the energization and the transportation were stopped.

Then, a sample was prepared in the same manner as in Example 3 except that the water level of the bath was kept unchanged. At this time, the conductivity of the water inside the rinsing tank as measured by a conductometric meter (trade name SC-82, mfd. by Yokokawa Denki) was 22.2 μS/cm.

After the sample was cut out from the formed substrate and visually observed within a range of 355 mm×300 mm, the film thickness distribution in the width direction was measured at the five points of the center, both ends, and middles between the center and the both ends based on the waveform of the optical characteristics with an analyzer (trade name V-570, mfd. by Nihon Bunko Co., Ltd.) according to the optical interference method, and the number of abnormal growths within a range of 10 mm×10 mm was counted by observation with an SEM (trade name S-4500. mfd. by Hitachi, Ltd.). Further, the sample was left to stand for 1000 hours in an atmosphere of 85° C. temperature and 85% relative humidity, and then subjected to the cross cut test (JIS K5400 8.5.2). The results are shown in Table 1.

TABLE 1

| | Visual observation (350 mm × 300 mm) | Film thickness distribution (Five points measurement) | SEM observation (10 mm × 10 mm) | Cross cut test |
|---|---|---|---|---|
| Example 1 | no deposit | 1.20 ± 0.25 μm | 12 abnormal growths | 10 points (full mark)/ no peeling |
| Example 2 | no deposit | 1.19 ± 0.05 μm | 3 abnormal growths | 10 points (full mark)/ no peeling |
| Example 3 | no deposit | 1.21 ± 0.05 μm | 1 abnormal growth | 10 points (full mark)/ no peeling |
| Comparative Example 1 | 250 deposits of 10–100 μm size | 1.19 ± 0.25 μm | 180 abnormal growths | 8 points/ slight peeling |
| Comparative Example 2 | 870 deposits of 10–100 μm size | 1.20 ± 0.23 μm | 452 abnormal growths | 8 points/ slight peeling |

From the results shown in Table 1, the following can be concluded.

That is, according to Example 1, it is possible to form a zinc oxide thin film which is free from deposits (or attachments) on its surface, has few abnormal growths in the film, and has a high adhesion to the support. According to Example 2, it is possible to form a zinc oxide thin film which has fewer abnormal growths in the film and has a smaller film thickness distribution. According to Example 3, it is possible to form a zinc oxide thin film which is free from deposits (or attachments) on its surface regardless of the length of time period of stopping of the apparatus after the electrodeposition, has few abnormal growths in the film, and has a high adhesion to the support.

Specifically, lowering the water level of the electrodeposition apparatus than the long substrate makes it possible to form a zinc oxide thin film which is free from deposits (or attachments) on its surface, has few abnormal growths in the film, and has a high adhesion to the support, regardless of the time period length of stopping of the apparatus after the electrodeposition.

Furthermore, lowering the water level of the electrodeposition apparatus than the zinc (opposing electrode) makes it possible to form a zinc oxide thin film which has fewer abnormal growths in the film and has a smaller film thickness distribution, regardless of the time period length of stopping of the apparatus after the electrodeposition.

Example 4

The roll-to-roll apparatus shown in FIG. 2 (and FIGS. 3 to 9) was used to make experiment. On SUS 430 2D stainless steel sheet wound into a roll, previously silver was deposited in 2,000 Å thickness by means of a roll-adapted DC magnetron sputtering apparatus and zinc oxide was deposited in thin film thereon in 2,000 Å thickness by means of a like roll-adapted DC magnetron sputtering apparatus to obtain the long substrate 2006. On this substrate, the zinc oxide film 103 was formed.

The long substrate 2006 is transported to zinc oxide film forming tanks. The first electrodeposition tank 2066 and the second electrodeposition tank 2116 each hold an electrodeposition bath containing 0.18 mol/L of zinc nitrate and 0.9 g/L of dextrin. In order to stir the baths, liquid circulation is carried out between the electrodeposition tanks 2066, 2116 and the circulation tanks 2120, 2222 with circulation pumps, respectively. The baths are each kept at a temperature of 85° C. Zinc plates (350 cm×150 cm) are used in the first electrodeposition anodes 2026 to 2053 and the second electrodeposition anodes 2076 to 2103. The long substrate 2006 was set as the negative-side electrode (cathode), where electric current of 10.0 mA/cm$^2$ (1.0 A/cm$^2$) was flowed across the positive-side electrodes 2026 to 2053 and 2076 to 2103 and the negative-side electrode 2006 each, and also the back-side film adhesion preventive electrodes 2061 and 2111 were set as negative-side electrodes and the long substrate 2006 was set as the positive-side electrode, where electric current of 50.0 mA/cm$^2$ (5.0 A/cm$^2$) was flowed across the positive-side electrode 2006 and the negative-side electrodes 2061 and 2111. Film formation was continuously carried out for 8 hours (720 m in forming length) at a substrate transporting speed of 1,500 mm/min.

In this example, in order to ensure that the water levels of the electrodeposition tanks 2066, 2116 are each lower than the zincs after stopping the pumps, and the electrodeposition tanks 2066, 2116 are disposed at higher positions than the circulation tanks 2120, 2222. After the stopping of the electrodeposition apparatus for 20 hours, the baths were each reheated to a temperature of 85° C. and film formation was continuously carried out for 8 hours (720 m in forming length) in the same manner as mentioned above. Similarly, the 8 hours successive film formation and the 20 hours stopping were repeated five times.

For every successive film formation, the conductivity of the water inside the rinsing tank immediately after the start of film formation was measured by a conductometric meter (trade name SC-82, mfd. by Yokokawa Denki). Further, after a sample of the substrate formed immediately after the start of film formation was cut out and visually observed within a range of 355 mm×300 mm, the film thickness distribution in the width direction was measured in the same manner as mentioned above based on the waveform of the optical characteristics with an analyzer (trade name V-570, mfd. by Nihon Bunko Co., Ltd.) according to the optical interference method, and the number of abnormal growths within a range of 10 mm×10 mm was counted by observation with an SEM (trade name S-4500, mfd. by Hitachi, Ltd.). Further, the sample was left to stand for 1000 hours in an atmosphere of 85° C. temperature and 85% relative humidity, and then subjected to the cross cut test (JIS K5400 8.5.2). The results are shown in Table 2.

TABLE 2

| | Visual observation (350 mm × 300 mm) | Film thickness distribution (Five points measurement) | SEM observation (10 mm × 10 mm) | Cross cut test |
|---|---|---|---|---|
| First Film formation | no deposit | 2.21 ± 0.05 μm | 1 abnormal growth | 10 points (full mark)/ no peeling |
| Second Film formation | no deposit | 2.21 ± 0.05 μm | 3 abnormal growths | 10 points (full mark)/ no peeling |
| Third Film formation | no deposit | 2.23 ± 0.05 μm | 3 abnormal growth | 10 points (full mark)/ no peeling |
| Forth Film formation | no deposit | 2.21 ± 0.05 μm | 1 abnormal growth | 10 points (full mark)/ no peeling |
| Fifth Film formation | no deposit | 2.20 ± 0.05 μm | 2 abnormal growths | 10 points (full mark)/ no peeling |

From the results shown in Table 2, the following can be concluded.

That is, by using the zinc oxide film forming apparatus according to the present invention, it is possible to form zinc oxide thin films with high reliability even when repeating film formation for a long period of time and stopping of the apparatus for a long period of time.

As having been described above, according to the present invention, with the zinc oxide film forming apparatus of the roll-to-roll system, it is possible to successively form a zinc oxide thin film which is free from deposits (or attachments) on its surface, has a uniform film thickness distribution, has few abnormal growths in the film, and has a high adhesion to the support, even when repeatedly using the same bath.

Introduction of this zinc oxide film formation technique into solar-cell fabrication processes as a technique for forming the back reflecting layer also enables solar cells to have higher short-circuit current density and photoelectric conversion efficiency and also enables them to be improved in yield characteristics and durability. Also, compared with sputtering and vacuum evaporation, the material cost and running cost can be made very low (i.e., cost of about 1/100), and hence the present invention can contribute to real spread of sunlight electricity generation.

What is claimed is:

1. A process for producing a zinc oxide film comprising the steps of:

transporting a conductive long substrate via above at least one electrode comprised of zinc in an electrodeposition bath held in an electrodeposition tank and applying an electric field between the electrode and the conductive long substrate, thereby forming a zinc oxide film on the conductive long substrate, the process comprising:

a first step of forming the zinc oxide film on a part of the conductive long substrate;

a second step of stopping the application of the electric field and the transportation;

a third step of bringing at least a part of the conductive long substrate, which is in contact with the electrodeposition bath in the second step, out of contact with the electrodeposition bath; and a fourth step of re-contacting at least a portion of the part of the conductive long substrate brought out of contact with the electrodeposition bath in said third step with the electrodeposition bath.

2. The process according to claim 1, further comprising, after the fourth step, a fifth step of restarting the application of the electric field and the transportation to form a zinc oxide film on the conductive long substrate.

3. The process according to claim 1, wherein a water level of the electrodeposition bath is lowered in the third step.

4. The process according to claim 1, wherein the third step further comprises keeping at least the part of the conductive long substrate out of contact with the electrodeposition bath by holding means provided above the electrodeposition bath.

5. The process according to claim 1, wherein the conductive long substrate comprises a conductive layer comprised of silver.

6. The process according to claim 1, wherein the electrodeposition bath contains zinc ions of 0.05 mol/L or more.

* * * * *

UNITED STATES PATENT AND TRADEMARK OFFICE

CERTIFICATE OF CORRECTION

PATENT NO. : 6,733,650 B2
DATED : May 11, 2004
INVENTOR(S) : Sonoda et al.

It is certified that error appears in the above-identified patent and that said Letters Patent is hereby corrected as shown below:

Title page,
Item [*] Notice, delete the phrase "by 157" and insert -- by 134 days --.

Column 1,
Line 65, "Industrial" should read -- industrial --.

Column 2,
Line 57, "elements" should read -- elements. --.

Column 3,
Line 67, "invention:" should read -- invention; --.

Column 8,
Line 3, "unwontedly" should read -- unwantedly --.

Column 9,
Line 61, "oft" should read -- off --.

Column 11,
Line 25, "Is" should read -- is --.

Column 12,
Line 18, "Insulating" should read -- insulating --.

Column 18,
Line 24, "nnd" should read -- and--; and
Line 45, "removed" should read -- be removed --.

Column 20,
Line 56, "In" should read -- in --.

Column 22,
Line 67, "1270 mm/min." should read -- 1270 mm/min, --.

Column 23,
Line 64, "In" should read -- in --.

UNITED STATES PATENT AND TRADEMARK OFFICE

CERTIFICATE OF CORRECTION

PATENT NO. : 6,733,650 B2
DATED : May 11, 2004
INVENTOR(S) : Sonoda et al.

It is certified that error appears in the above-identified patent and that said Letters Patent is hereby corrected as shown below:

Column 26,
Table 2, "growth" should read -- growths --.

Signed and Sealed this

Thirty-first Day of May, 2005

JON W. DUDAS
*Director of the United States Patent and Trademark Office*